US011360437B2

(12) United States Patent
King, III

(10) Patent No.: US 11,360,437 B2
(45) Date of Patent: Jun. 14, 2022

(54) ADJUSTABLE SUNDIAL ASSEMBLY

(71) Applicant: Clinton S. King, III, Manhattan, MT (US)

(72) Inventor: Clinton S. King, III, Manhattan, MT (US)

( * ) Notice: Subject to any disclaimer, the term of this patent is extended or adjusted under 35 U.S.C. 154(b) by 163 days.

(21) Appl. No.: 16/780,690

(22) Filed: Feb. 3, 2020

(65) Prior Publication Data

US 2020/0249629 A1 Aug. 6, 2020

Related U.S. Application Data

(60) Provisional application No. 62/801,503, filed on Feb. 5, 2019.

(51) Int. Cl.
*G04B 49/04* (2006.01)

(52) U.S. Cl.
CPC ..... *G04B 49/04* (2013.01)

(58) Field of Classification Search
CPC ..... G04B 49/04; G04B 49/02
See application file for complete search history.

(56) References Cited

U.S. PATENT DOCUMENTS 78,133 A * 5/1868 Risch ..... G04B 49/00 33/271
667,785 A * 2/1901 Lietz ..... G01C 17/34 33/268
740,978 A * 10/1903 Hewitt ..... G04B 49/02 33/270
1,570,029 A * 1/1926 Balch ..... G04B 49/02 33/270
1,817,350 A 8/1931 Spencer
2,192,750 A * 3/1940 Mead ..... G04B 49/02 33/270
2,754,593 A * 7/1956 Sundblad ..... G04B 49/02 33/270
3,786,570 A * 1/1974 Davies ..... G04B 49/02 33/270
3,815,249 A * 6/1974 Gundlach ..... G04B 49/00 33/269
4,102,054 A 7/1978 Lewis
4,103,429 A * 8/1978 Wagoner ..... G04B 49/00 33/270
D257,006 S 9/1980 Santleben
4,355,470 A * 10/1982 Doyle ..... G04B 49/04 33/270
4,645,354 A 2/1987 Mercer
4,785,542 A * 11/1988 Haskett ..... G04B 49/02 33/270
4,845,853 A * 7/1989 Haskett ..... G04B 49/02 33/270
5,062,212 A 11/1991 Blaker
D413,821 S 9/1999 Zurfluh
6,301,793 B1 * 10/2001 Gottesman ..... G04B 49/02 33/270
6,523,270 B1 2/2003 Cheung
(Continued)

*Primary Examiner* — Yaritza Guadalupe-McCall
(74) *Attorney, Agent, or Firm* — Dorsey & Whitney LLP

(57) ABSTRACT

An adjustable sundial assembly includes a base, a saddle slidably connected to the base to move in an arc, a housing adjustably coupled to the saddle, and an equatorial sundial attached to the housing. Movement of the saddle relative to the base and/or the housing relative to the saddle calibrates the sundial to a local latitude at which the sundial is positioned.

20 Claims, 24 Drawing Sheets

(56) References Cited

U.S. PATENT DOCUMENTS

| | | | | |
|---|---|---|---|---|
| 6,604,290 | B1 * | 8/2003 | Hughes, Jr. | G04B 49/02 33/270 |
| D581,294 | S * | 11/2008 | Farricielli | D10/45 |
| 7,950,159 | B2 * | 5/2011 | Popendorf | G04B 49/04 33/270 |
| 8,205,346 | B1 | 6/2012 | Cheng | |
| 8,387,265 | B2 * | 3/2013 | Popendorf | G04B 49/02 33/270 |
| 9,727,025 | B1 * | 8/2017 | Rupert | G04B 49/02 |
| D900,648 | S * | 11/2020 | King, III | D10/45 |
| 2003/0029047 | A1 * | 2/2003 | Cheung | G04B 49/02 33/270 |
| 2005/0060900 | A1 | 3/2005 | Maegli | |
| 2020/0249629 | A1 * | 8/2020 | King, III | G04B 49/04 |

* cited by examiner

251

ADJUSTABLE SUNDIAL ASSEMBLY

CROSS REFERENCE TO RELATED APPLICATIONS

This application claims the benefit of priority from U.S. Provisional Application No. 62/801,503, filed 5 Feb. 2019, and entitled ADJUSTABLE SUNDIAL ASSEMBLY, the disclosure of which is incorporated, in its entirety, by this reference.

TECHNICAL FIELD

The present disclosure relates to sundials, and more specifically to a sundial assembly that is adjustable to local position.

BACKGROUND

Many sundials exist to approximate the time of day and year at a particular location on Earth. Many sundials are installed in a permanent manner and may not be repositionable. Due to such permanent-type installation, many sundials may display the incorrect time of day and/or time of year when repositioned. For instance, due to the high sensitivity of sundials to local latitude, repositioning "permanent-type" sundials to a location with a different latitude will result in incorrect time measurement and/or display. This requires each sundial to be set for a particular latitude, such as in situ or from a factory.

The information included in this Background section of the specification, including any references cited herein and any description or discussion thereof, is included for technical reference purposes only and is not to be regarded subject matter by which the scope of the invention as defined in the claims is to be bound.

SUMMARY

The technology disclosed herein relates to sundial devices and methods for calibrating an adjustable sundial for local latitude and/or local longitude. More specifically, the present disclosure is directed to adjustable sundials with a plurality of components, the relative position of the various components being adjustable to account for local latitude and/or local longitude.

One aspect of the present disclosure relates to an adjustable sundial assembly. The sundial may include a base, a saddle slidably connected to the base to move in an arc, a housing adjustably coupled to the saddle, and an equatorial sundial attached to the housing. Movement of the saddle relative to the base and/or the housing relative to the saddle may calibrate the sundial to a local latitude at which the sundial is positioned.

Optionally, the equatorial sundial may include a first bow element having a first arc shape. The equatorial sundial may include a second bow element having a second arc shape. The first and second bow elements may be attached together at a connection portion of the housing. A plane defined by the first bow element may extend perpendicularly to a plane defined by the second bow element. A calendar plate may be attached to, or formed integrally with, the housing. An aperture may be defined through the connection portion of the housing such that light passing through the aperture is focused onto the calendar plate. A plurality of graduations may be defined on the first bow element, with each graduation corresponding to a time of day. A gnomon may be connected to the second bow element to cast a shadow on the graduations of the first bow element to indicate the time of day. The gnomon may be a bow string attached to terminal ends of the second bow element. The first arc shape may be different than the second arc shape.

Optionally, the sundial assembly may include an adjustment assembly to slidably adjust the saddle relative to the base. The adjustment assembly may include an adjustment mechanism operable to move the saddle relative to the base, a scale associated with the base, and a pointer connected to the saddle and positioned to move along the scale to indicate the position of the saddle relative to the base. The adjustment mechanism may be a leadscrew.

Optionally, the saddle may include a plurality of bores. The housing may include at least one boss received within a selected one or more bores of the plurality of bores to adjustably couple the housing to the saddle.

Optionally, the saddle may sit atop the base, the housing may sit atop the saddle, and the equatorial sundial may sit atop the housing.

Optionally, moving the saddle relative to the base may tilt the equatorial sundial toward the base. Moving the housing relative to the saddle may also tilt the equatorial sundial toward the base.

Another aspect of the disclosure relates to an adjustable sundial including a gnomon, a first adjustment mechanism, and a second adjustment mechanism. The first and second adjustment mechanisms may be operable to adjust an angle between the gnomon and a horizontal plane to account for local latitude. The first adjustment mechanism may alter the angle in one or more mass increments. The second adjustment mechanism may alter the angle in increments up to a single mass increment of the first adjustment mechanism.

Optionally, each mass increment may be a ten degree increment. The first adjustment mechanism may include adjustment stops at each of 0 degrees, 10 degrees, 20 degrees, 30 degrees, 40 degrees, 50 degrees, 60 degrees, 70 degrees, and 80 degrees relative to horizontal. The second adjustment mechanism may alter the angle between each ten degree increment.

Optionally, the first adjustment mechanism may include a boss received within one of a plurality of bores defining the one or more mass increments. The plurality of bores may be defined on a saddle slidably connected to a base of the sundial. The boss may be defined on a housing to adjustably couple the housing to the saddle. The second adjustment mechanism may selectively slide the saddle relative to the base.

Optionally, the gnomon may be defined as a bow string of an equatorial sundial.

Another aspect of the present disclosure relates to a sundial assembly. The sundial assembly includes an equatorial sundial having an aperture defined therethrough and a calendar plate positioned below the equatorial sundial such that light passing through the aperture is focused onto the calendar plate to determine the current date.

Optionally, the equatorial sundial may include a first bow element, a second bow element, and a gnomon connected to and extending between terminal ends of the second bow element. The aperture may be defined through each of the first and second bow elements at the intersection between the first and second bow elements. A plurality of graduations may be defined on the first bow element, each graduation corresponding to a time of day. The gnomon may cast a shadow on the graduations to indicate the time of day.

Optionally, the sundial assembly may include a base, a saddle slidably connected to the base to move in an arc, and a housing adjustably coupled to the saddle. The calendar plate may be attached to or formed integrally with the housing. The equatorial sundial may be attached to the housing.

Optionally, the aperture may be cone shaped, with the aperture widening toward the calendar plate. The widening angle of the aperture may be equal to or greater than 47 degrees.

Still another aspect of the disclosure relates to a method of adjusting a sundial to account for local latitude. The method may include aligning a base member of the sundial with either the pole star or the southern cross constellation, connecting an intermediate member to the base member at a first position, connecting a tertiary member to the intermediate member at a position relative to the intermediate member corresponding to a latitude less than the local latitude, and moving the intermediate member relative to the base member to a second position, the second position corresponding to the local latitude.

Optionally, connecting the tertiary member to the intermediate member may include positioning one or more bosses of the tertiary member within one or more bores defined in the intermediate member. Moving the intermediate member relative to the base member may include sliding the intermediate member along a portion of the base member in an arc.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various examples and implementations and illustrated in the accompanying drawings.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
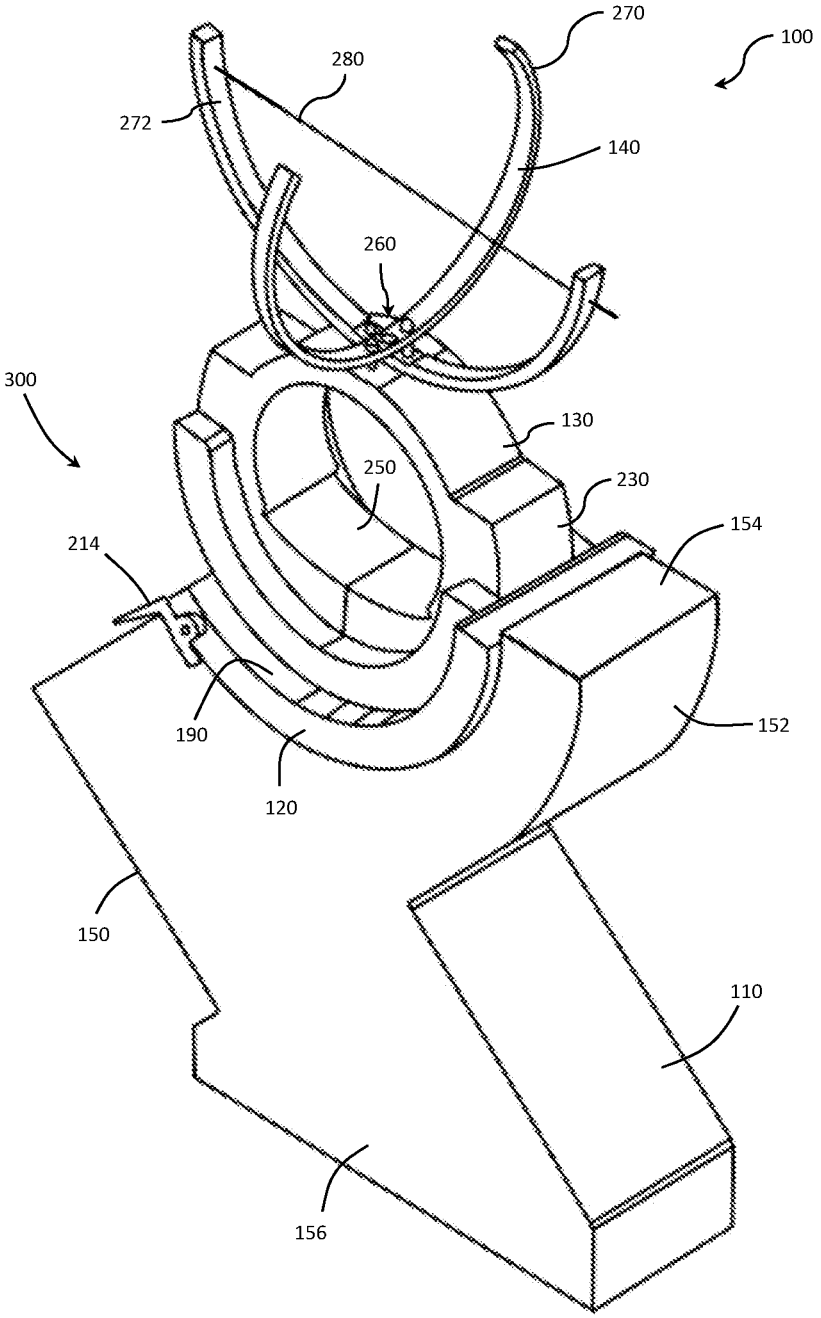
FIG. 1 is an isometric view of an adjustable sundial assembly according to some embodiments of the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure relates to embodiments of sundial assemblies that are adjustable to their local positions and related methods. A sundial assembly may include a plurality of components interlocked together. The relative positions of the various components may be adjusted to account for local latitude and/or local longitude. For instance, one or more components of the sundial assembly may selectively move to alter the angle of a gnomon of an equatorial sundial relative to horizontal to account for at least local latitude. In particular, the relative positions of the various components of the sundial assembly may be altered to increase or decrease the angle between the gnomon and horizontal to account for increasing or decreasing latitudinal positions, respectively. The sundial assembly may include a plurality of adjustment mechanisms, with a first adjustment mechanism altering the angle in one or more mass increments, and a second adjustment mechanism altering the angle in increments up to a single mass increment of the first adjustment mechanism.

Turning to the figures, illustrative examples and embodiments of the present disclosure will now be discussed in detail. FIGS. 1-5 illustrate various views of an adjustable sundial assembly 100. As shown, the sundial assembly 100, which may be referred to simply as a sundial, includes a plurality of components interlocked together in series. As described more fully below, the interlocking of the components in series may account for local latitude such that the sundial assembly 100 is generally accurate regardless of where the sundial assembly 100 is installed. For instance, the sundial assembly 100 may be adjustable (either manually by the user or automatically) to calibrate the sundial assembly 100 for the location in which it is installed. More particularly, the sundial assembly 100 may be moved from a first location to a second location and adjusted to accurately display the time of day, the current date, or both for the second location after adjustment of the sundial's components for the local latitude of the second location. In some examples, the sundial assembly 100 may be adjusted to also account for local longitude of the second location.

As described herein, "local latitude" means the actual latitudinal position at which the sundial assembly 100 is located. In particular, local latitude means the north-south position of the sundial assembly 100 between the North Pole and the South Pole. Similarly, "local longitude" means the actual longitudinal position at which the sundial assembly 100 is located. Specifically, local longitude means the east-west position of the sundial assembly 100 relative to the Prime Meridian. For example, installation of the sundial assembly 100 in Bozeman, Mont., requires the sundial assembly 100 to be calibrated for a latitude of approximately 45.7° N to provide accurate time and date readings. Installation of the sundial assembly 100 in Denver, Colo., requires the sundial assembly 100 to be calibrated for a latitude of approximately 39.7° N to provide accurate time and date readings. Should the sundial assembly 100 be moved from Bozeman, Mont., to Denver, Colo., the sundial assembly 100 would inaccurately display the time and date in Denver, Colo., without adjustment of the various components of the sundial assembly 100. Unlike some conventional sundials, the sundial assembly 100 allows for such repositioning and efficient recalibration of the sundial assembly 100. In this manner, the sundial assembly 100 may be moved to and calibrated for the latitude and/or longitude at which the sundial assembly 100 is positioned to provide accurate time and date readings, as detailed below.

The sundial assembly 100 may include many configurations that account for local latitude. As one example, the various components of the sundial assembly 100 may be interlocked together around a central axis P or pivot point (see FIG. 6). As explained more fully below, one or more components of the sundial assembly 100 may be adjusted (such as about the central axis P or pivot point) to account for local latitude such that the sundial assembly 100 accurately displays or reads the correct time of day and/or time of year for the latitudinal position at which the sundial assembly 100 is placed. Additionally or alternatively, one or more components of the sundial assembly 100 may be adjusted to account for local longitude such that the sundial assembly 100 accurately displays or reads the correct time of day and/or time of year for the longitudinal position at which the sundial assembly 100 is placed.

In this manner, the sundial assembly 100 may be adjusted per the location at which the sundial assembly 100 is positioned. Consequently, the sundial assembly 100 may be utilized to accurately read and interpret daylight hours of time from substantially any observer position (latitude and/or longitude). In addition to accurately reading and interpreting daylight hours of time, the sundial assembly 100 may allow a user to track, record, and otherwise interpret the sun's declination cycle throughout the year, thereby accurately reading and interpreting the time of year.

Additionally, the sundial assembly 100 may be repositioned and easily adjusted to accurately display or read the correct time of day and/or time of year at the new position. Some conventional sundials are installed in a permanent manner and may not be repositionable. Also, due to their permanent-type installation, some conventional sundials may display the incorrect time of day and/or time of year when repositioned. For instance, due to the high sensitivity of sundials to local latitude, repositioning a permanent-type sundial setup to a location with a different latitude will result in incorrect time measurement and/or or display. The sundial assembly 100 disclosed herein may allow readjustment of the sundial assembly 100 when repositioning to a different location. Furthermore, the same sundial assembly 100 may be provided to various users (e.g., commercial sales, etc.), and the sundial assemblies adjusted by the user to accurately display the correct time of day and/or time of year at each location.

With continued reference to FIGS. 1-5, the sundial assembly 100 may include a plurality of components adjustably coupled to one another. For example, the sundial assembly 100 may include a base 110, a saddle 120, a housing 130, and an equatorial sundial 140 adjustably coupled together. Depending on the particular application, the saddle 120 may sit atop the base 110, the housing 130 may sit atop the saddle 120, and the equatorial sundial 140 may sit atop the housing 130.

The saddle 120, which may be referred to as an intermediate member, may be slidably connected to the base 110. For example, as detailed below, the saddle 120 may be slidably connected to the base 110 to move in an arc. In such examples, the arcing movement of the saddle 120 relative to the base 110 may adjust the equatorial sundial 140 to account for local latitude. For example, moving the saddle 120 relative to the base 110 may tilt the equatorial sundial 140 toward the base 110 (e.g., toward or away from top portion 154) to account for local latitude.

Additionally or alternatively, the housing 130 may be adjustably coupled to the saddle 120. In such examples, relative movement between the housing 130 and the saddle 120 may adjust the equatorial sundial 140 to account for local latitude. For instance, movement of the housing 130 relative to the saddle 120 may tilt the equatorial sundial 140 toward the base 110 to account for local latitude. In some examples, adjustment of the sundial assembly 100 for local latitude may require both relative movement between the saddle 120 and the base 110, and relative movement between the housing 130 and the saddle 120. As shown, the equatorial sundial 140 may be attached to the housing 130, such as to a top portion of the housing 130 (e.g., at aperture 260).

Figure 6:
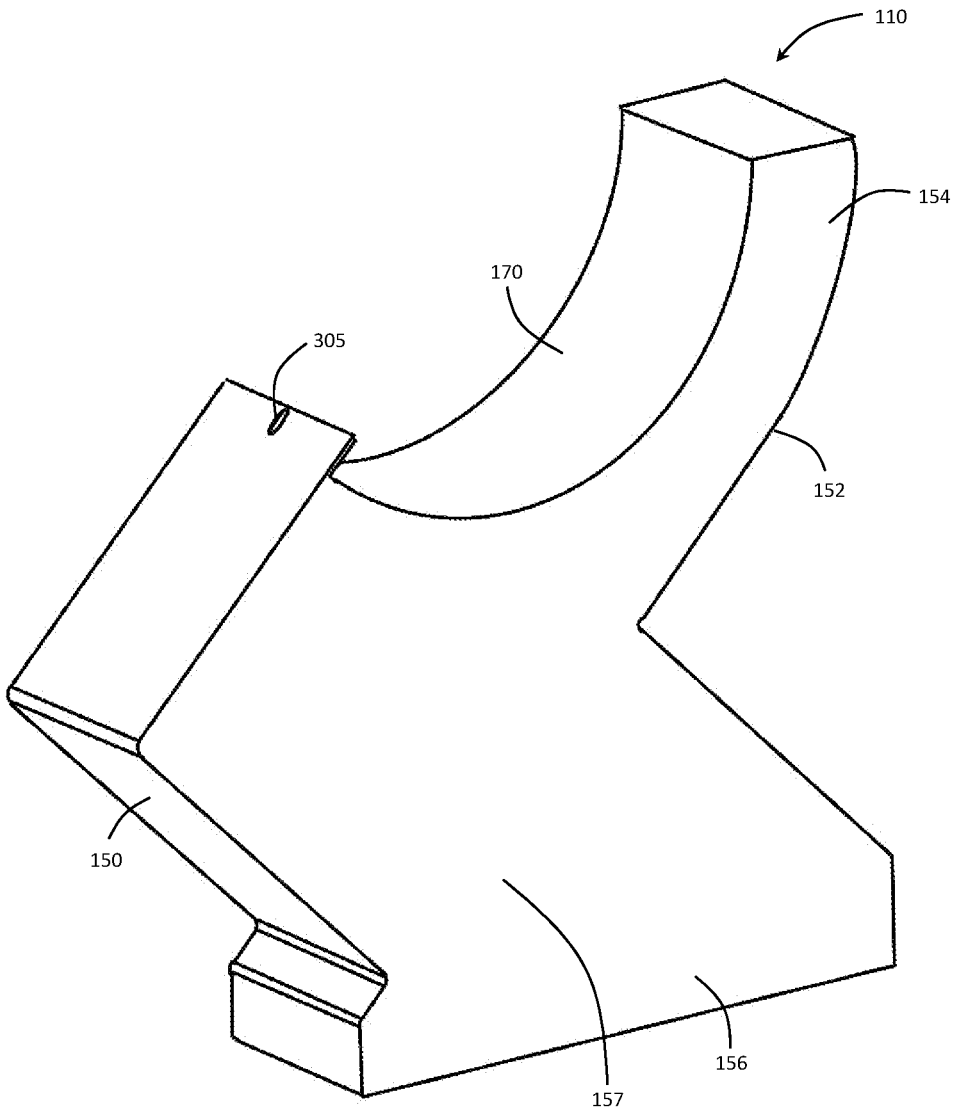
FIG. 6 is an isometric view of a base member of the adjustable sundial assembly according to some embodiments of the present disclosure.

Referring to FIG. 6, the base 110, which may be referred to as a base member, may include many configurations operable to fix the sundial assembly 100 in position and/or hold the other components of the sundial assembly 100 in place. For instance, the base 110 may include a leading end portion 150, a trailing end portion 152, a top portion 154, and a bottom portion 156. The leading end portion 150 may generally define the front of the base 110, with the trailing end portion 152 generally defining the rear of the base 110. The leading and trailing end portions 150, 152 of the base 110 may combine to define an alignment plane. The alignment plane can be parallel to the flat vertical sides of the base 110 (e.g., vertical side 157) and positioned centrally between the flat vertical sides. In such examples, the base 110 may be aligned to position either the pole star or the southern cross constellation generally in plane with the alignment plane of the base 110. For instance, the base 110 may be positioned such that the trailing end portion 152 is pointed or directed generally toward either the pole star or the southern cross constellation depending on which hemisphere the sundial assembly 100 is positioned. More particularly, the trailing end portion 152 may be pointed or directed toward the pole star for installations of the sundial assembly 100 in the northern hemisphere. In like manner, the trailing end portion 152 may be pointed or directed toward the southern cross constellation for installations of the sundial assembly 100 in the southern hemisphere.

The top portion 154 of the base 110 may be sized and shaped to accommodate the slidable connection of the saddle 120 to the base 110. For example, the top portion 154 may include a bearing surface 170 along which the saddle 120 slidably engages. In such examples, the bearing surface 170 may be shaped to match (actually or generally) or correspond to a shape of the saddle 120, such as the shape of the bottom surface of the saddle 120. In particular, the bearing surface 170 may curve to match or correspond to a curved profile of the saddle 120. In such examples, the saddle 120 may slidably engage the bearing surface 170 of the base 110. In one example, the bearing surface 170 may be radially spaced from the central axis P (see FIG. 6), such as being defined by an are length rotating about the central axis P. The arc length of the bearing surface 170 may be defined by an angle less than a full rotation about the central axis P, such as less than 270 degrees about the central axis P, less than 180 degrees about the central axis P, less than 135 degrees about the central axis P, or less than 90 degrees about the central axis P. As shown, the bearing surface 170 may curve upwardly from the leading end portion 150 to the trailing end portion 152. In such examples, the trailing end portion 152 may include a height greater than the leading end portion 150 of the base 110.

The bottom portion 156 of the base 110 may be configured to secure the base 110 in position. For instance, the bottom portion 156 may be removably secured to a pedestal. In some examples, the base 110 may have sufficient mass or weight such that the base 110 rests firmly on the ground without moving. In some examples, the bottom portion 156 may be fixed in position, such as being cast in concrete, welded to a pedestal, or the like. In such examples, once the base 110 is aligned with either the pole star or the southern cross constellation, the base 110 may be secured in place, whether by its own weight, by being secured to a pedestal, or by being case into concrete, or the like.

The base 110 may include other features for convenience. For example, a scale 180 may be associated with the base 110. See FIG. 5. In one example, the scale 180 may be attached to or formed integrally with a side surface of the base 110, such as near the leading end portion 150. As explained more fully below, the scale 180 may indicate the position of the saddle 120 relative to the base 110. For instance, movement of the saddle 120 relative to the base 110 may cause an indicator (e.g., 214) to move along the scale 180 to indicate the position of the saddle 120 relative to the base 110. In this manner, the user may quickly assess the relative position between the saddle 120 and the base 110 in calibrating the sundial assembly 100 to local latitude.

The base 110 may be formed in many configurations. For instance, depending on the particular application, the base 110 may be formed by one or more pieces secured together. For instance, the base 110 may be formed from a plurality of pieces that are welded, fastened, or otherwise secured together. In some examples, the base 110 may be milled, cast, forged, molded, or sculpted from a solid piece of material. In some examples, the base 110 may be formed by cutting, stamping, rolling, bending, or the like.

Figure 7:
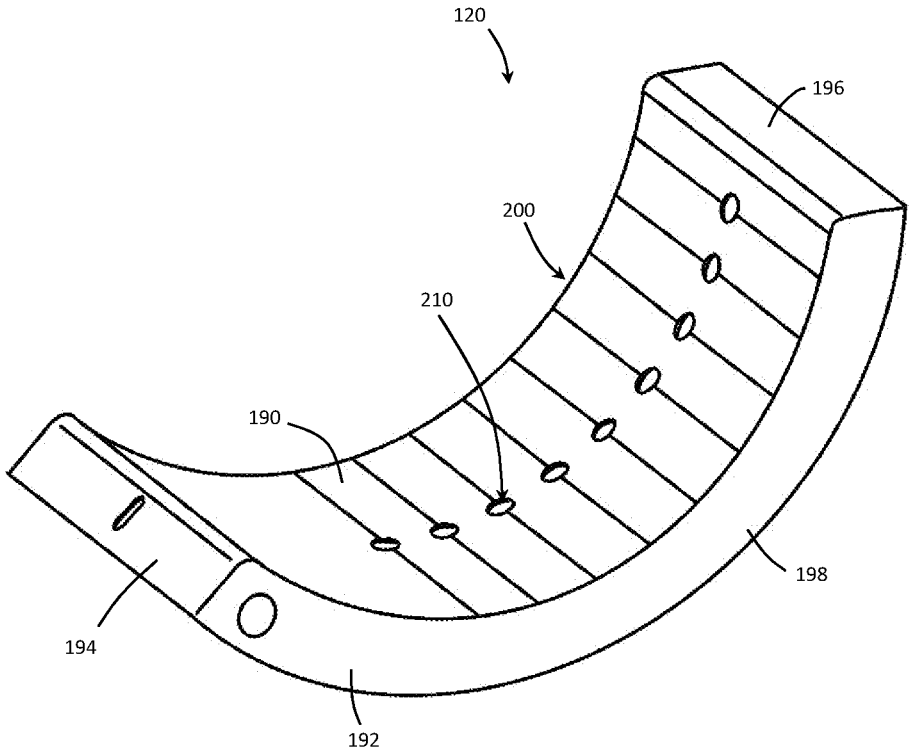
FIG. 7 is an isometric view of an intermediate saddle member of the adjustable sundial assembly according to some embodiments of the present disclosure.
Figure 8:
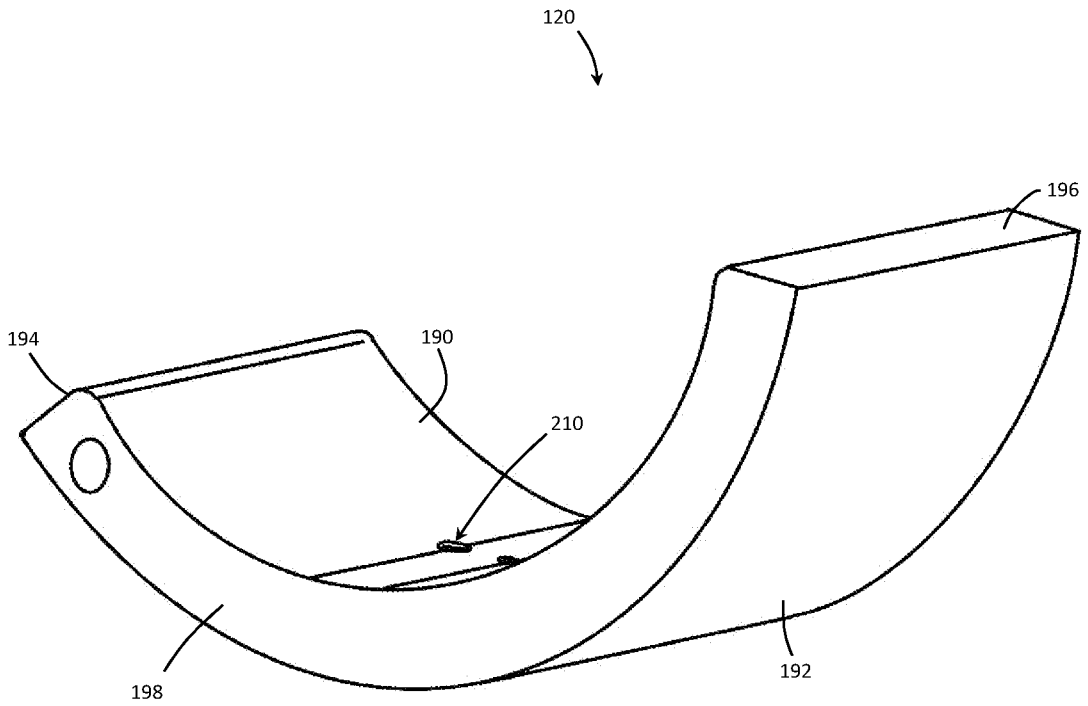
FIG. 8 is another isometric view of the intermediate saddle member of FIG. 7.

The saddle 120, which may be referred to as an intermediate member, may be slidably connected to the bearing surface 170 of the base 110 to move in an arc. As shown in FIGS. 7 and 8, the saddle 120 may include opposing top and bottom surfaces 190, 192, opposing first and second end panels 194, 196, and opposing third and fourth end panels 198, 200. In such examples, the first, second, third, and fourth end panels 194, 196, 198, 200 may extend between the top and bottom surfaces 190, 192. The bottom surface 192 of the saddle 120 may slidably engage the bearing surface 170 of the base 110. The top and bottom surfaces 190, 192 may be curved. In one example, the top and bottom surfaces 190, 192 may extend generally parallel to each other, such as in an arc shape. Each of the top and bottom surfaces 190, 192 may be radially spaced from the central axis P. For example, the top and bottom surfaces 190, 192 can be entirely evenly radially spaced from the central axis P. Like the bearing surface 170 of the base 110, the top and bottom surfaces 190, 192 of the saddle 120 may be defined by respective arc lengths rotating about the central axis P. In such examples, the top and bottom surfaces 190, 192 of the saddle 120 may be concentric with the bearing surface 170 of the base 110. Depending on the particular application, the arc lengths of the top and bottom surfaces 190, 192 may be defined by an angle less than a full rotation about the central axis P, such as less than 270 degrees about the central axis P, less than 180 degrees about the central axis P, less than 135 degrees about the central axis P, or less than 90 degrees about the central axis P. In some examples, the top and bottom surfaces 190, 192 may be defined by the same angle of rotation about the central axis P as the bearing surface 170 of the base 110.

Figure 2:
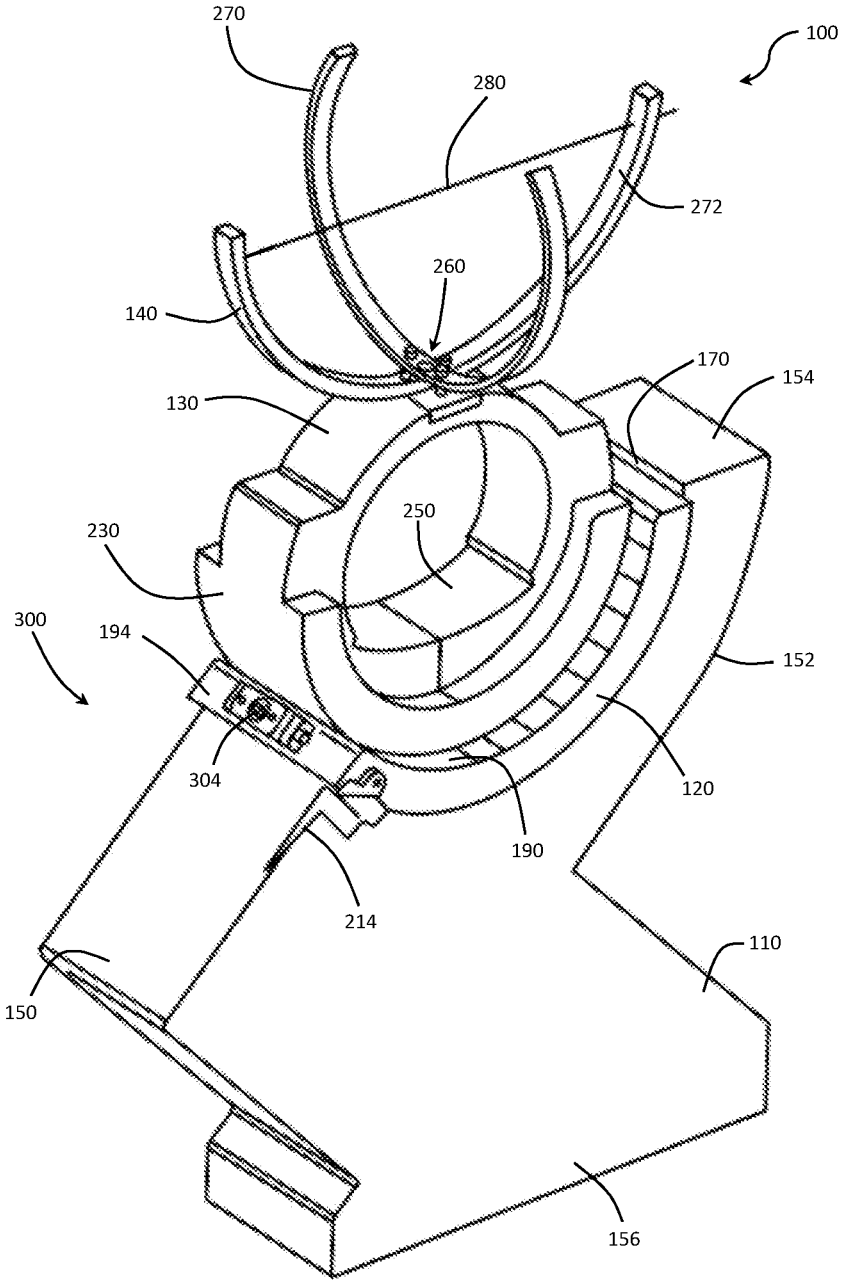
FIG. 2 is another isometric view of the adjustable sundial assembly of FIG. 1.
Figure 3:
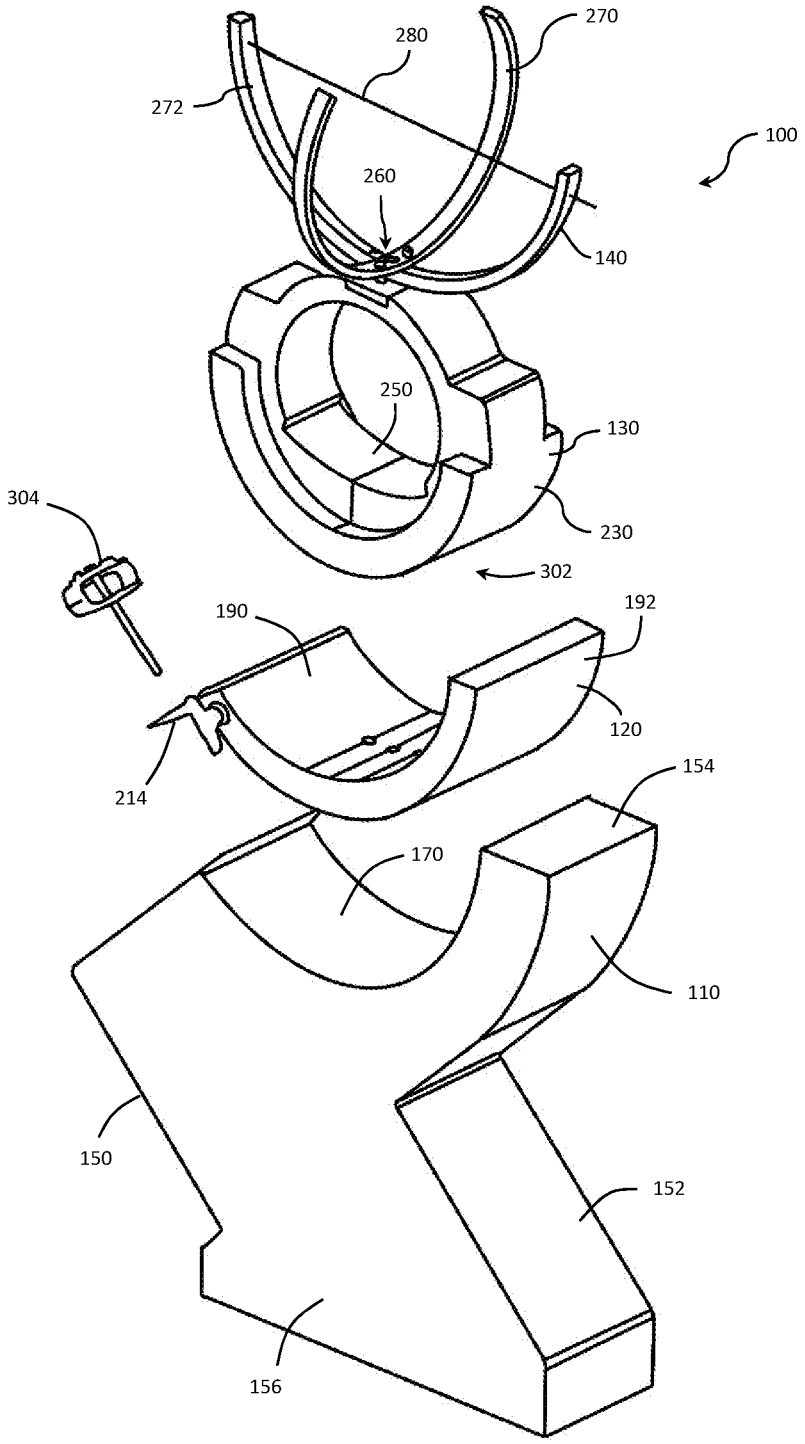
FIG. 3 is an exploded view of the adjustable sundial assembly of FIG. 1.
Figure 4:
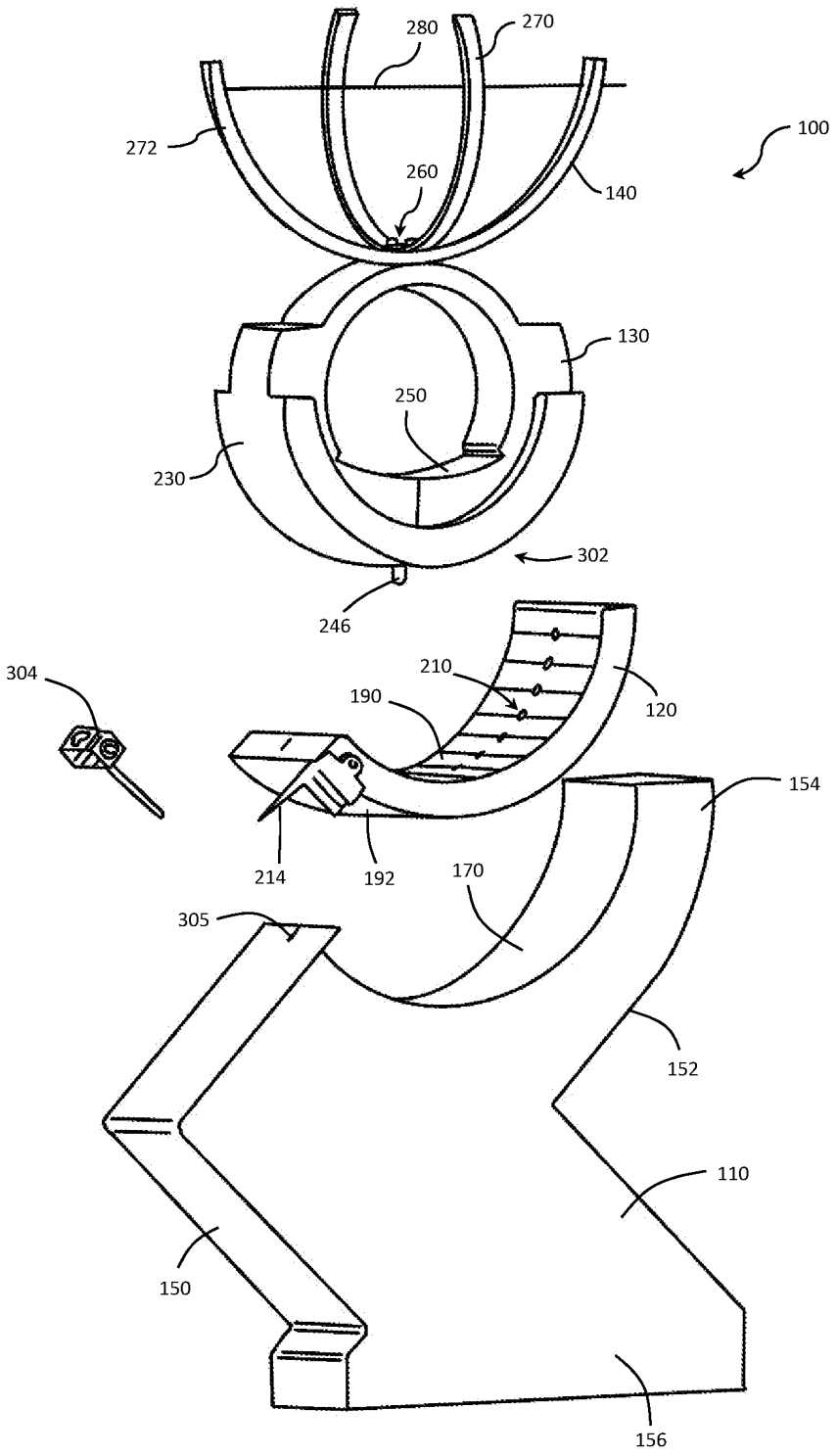
FIG. 4 is another exploded view of the adjustable sundial assembly of FIG. 1.
Figure 5:
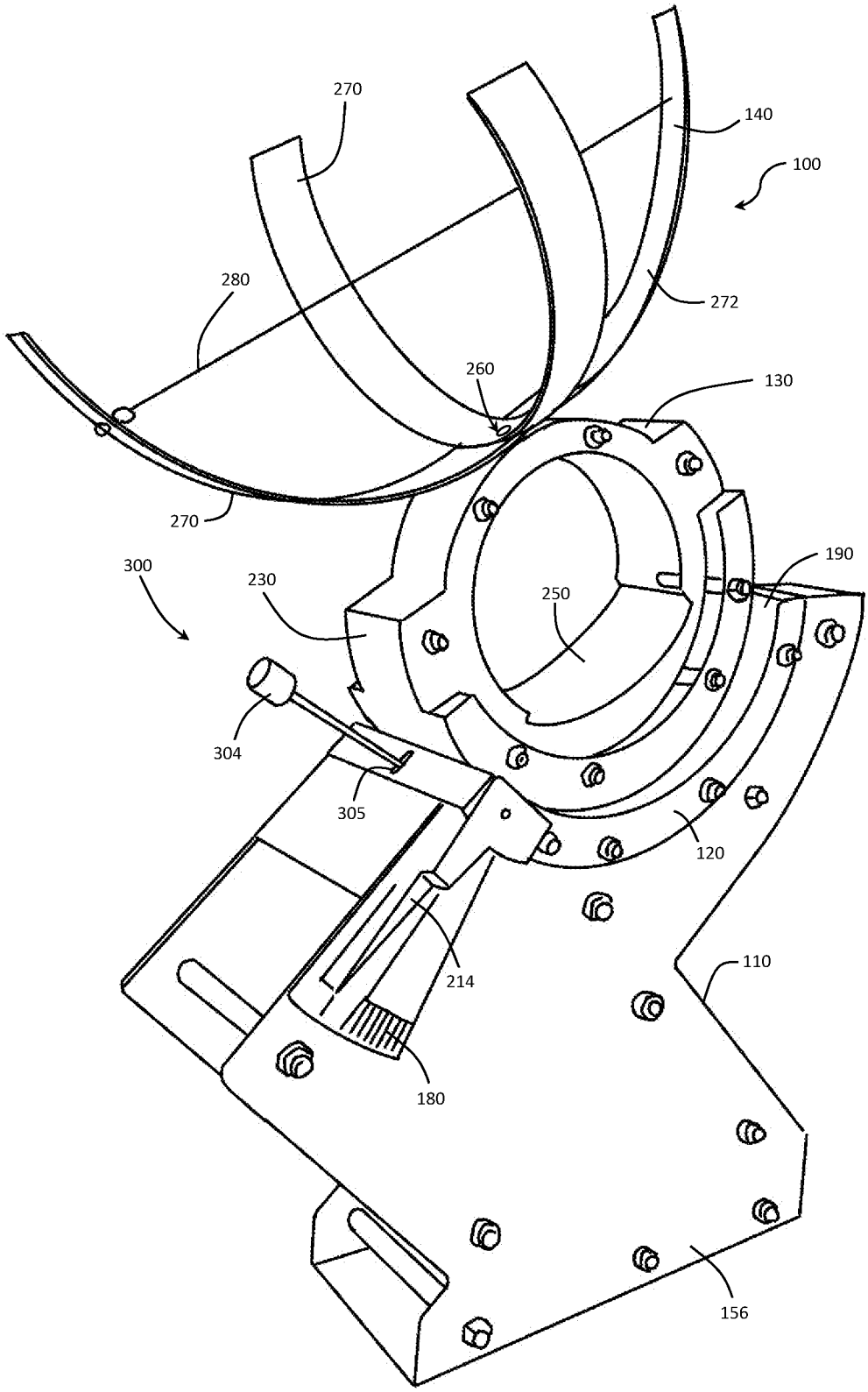
FIG. 5 is an isometric view of an additional adjustable sundial assembly according to some embodiments of the present disclosure.

Referring to FIG. 2, the first end panel 194 of the saddle 120 may be positioned adjacent to the leading end portion 150 of the base 110. The second end panel 196 of the saddle 120 may be positioned adjacent to the trailing end portion 152 of the base 110. In such examples, the first end panel 194 of the saddle 120 may move toward or away from the leading end portion 150 of the base 110 as the saddle 120 slides along the bearing surface 170 of the base 110. Similarly, the second end panel 196 of the saddle 120 may move toward or away from the trailing end portion 152 of the base 110 (e.g., toward or away from top portion 154) as the saddle 120 slides along the bearing surface 170 of the base 110.

The saddle 120 may include other features for convenience. For example, as shown in FIG. 7, the saddle 120 may include a plurality of bores 210 defined in at least the saddle's top surface 190. As shown, the bores 210 may be spaced along the top surface 190 between the first and second end panels 194, 196 of the saddle 120. Depending on the particular application, the bores 210 may be spaced equidistantly apart from one another or in a non-equidistant manner. Additionally, the bores 210 may be aligned linearly, such as along a centerline of the saddle 120 between the third and fourth end panels 198, 200. As described below, portions of the housing 130 may be received within at least one bore 210 of the saddle 120 to position the housing 130 relative to the saddle 120.

In some examples, a pointer 214 may be associated with the saddle 120. See FIG. 3. The pointer 214 may be connected to or formed integrally with the saddle 120, such as connected to one of the third and fourth end panels 198, 200. Accordingly, the pointer 214 may move synchronously with the saddle 120. In such examples, the pointer 214 may be positioned to move along the scale 180 of the base 110 to indicate the position of the saddle 120 relative to the base 110. For instance, as the saddle 120 moves relative to the base 110, the pointer 214 may move along the scale 180 to indicate the degree of movement of the scale 180 relative to the base 110.

Like the base 110, the saddle 120 may be formed in many configurations. For instance, depending on the particular application, the saddle 120 may be formed by one or more pieces secured together. For instance, the saddle 120 may be formed from a plurality of pieces that are welded, fastened, or otherwise secured together, such as the multi-part assembly that forms the saddle 120 in FIG. 5, wherein metal plates are bent or shaped into the outer surface shapes of the saddle 120 and then reinforced by bolts and tubular or rod-like support bars. In some examples, the saddle 120 may be milled cast, forged, molded, or sculpted from a solid piece of material. In some examples, the saddle 120 may be formed by cutting, stamping, rolling, bending, or the like.

Figure 9:
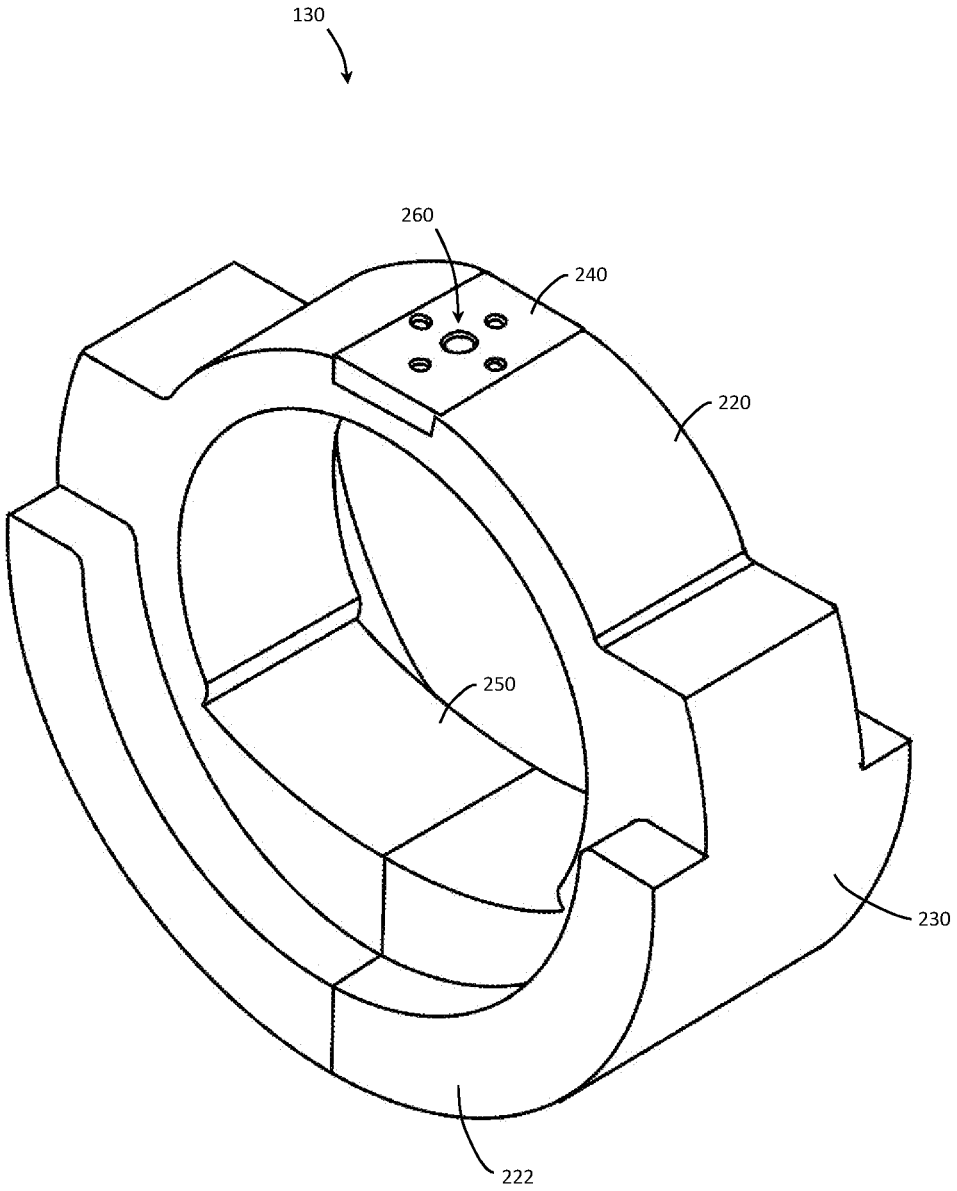
FIG. 9 is an isometric view of a tertiary housing member of the adjustable sundial assembly according to some embodiments of the present disclosure.
Figure 10:
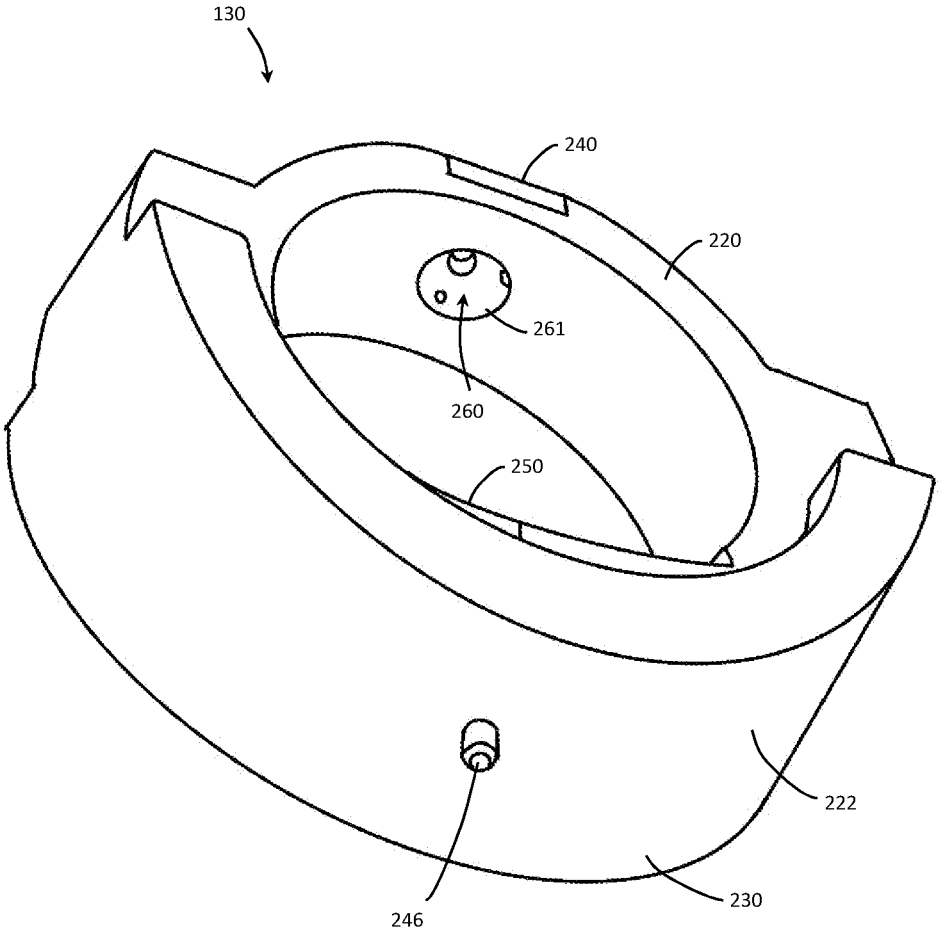
FIG. 10 is another isometric view of the tertiary housing member of FIG. 9.
Figure 11:
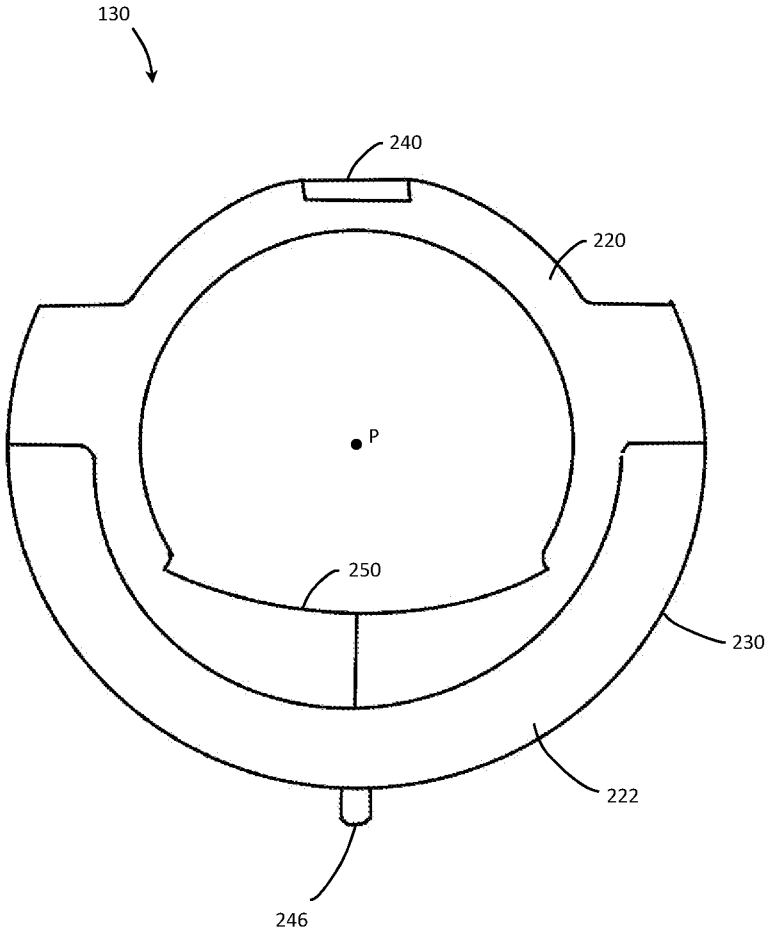
FIG. 11 is a side elevation view of the tertiary housing member of FIG. 9.

The housing 130, which may be referred to as a tertiary member, may be adjustably coupled to the top surface 190 of the saddle 120. As shown in FIGS. 9-11, the housing 130 may be formed generally as a ring with top and bottom portions 220, 222. In one example, the bottom portion 222 of the housing 130 may be defined, in part, by a curved outer surface 230. In such examples, the outer surface 230 of the housing 130 may engage the top surface 190 of the saddle 120. The outer surface 230 of the housing 130 may be radially spaced from the central axis P, such as defined by an arc length rotating about the central axis P. In such examples, the outer surface 230 may be concentric with the top and bottom surfaces 190, 192 of the saddle 120 and with the bearing surface 170 of the base 110. Depending on the particular application, the arc length of the outer surface 230 of the housing 130 may be defined by an angle less than a full rotation about the central axis P, such as less than 270 degrees about the central axis P, less than 180 degrees about the central axis P, less than 135 degrees about the central axis P, or less than 90 degrees about the central axis P. In some examples, the outer surface 230 may be defined by an angle of rotation about the central axis P greater than each of the top and bottom surfaces 190, 192 of the saddle 120 and the bearing surface 170 of the base 110.

The top and bottom portions 220, 222 of the housing 130 may be shaped similarly or different. For instance, in one example, the top portion 220 of the housing 130 may define or comprise a connection portion 240. As explained below, the connection portion 240 may be shaped to accommodate the equatorial sundial 140. For instance, the connection portion 240 may be sized and shaped to allow connection of the equatorial sundial 140 to the housing 130, which may require the top portion 220 of the housing 130 to be shaped differently than its bottom portion 222.

To connect the housing 130 to the saddle 120, the housing 130 may include at least one boss 246 or projection extending from the outer surface 230. See FIGS. 10-11. In such examples, the boss 246 may be sized for at least partial receipt within a selected one of more bores of the plurality of bores 210 of the saddle 120 to adjustably couple the housing 130 to the saddle 120. For instance, the boss 246 of the housing 130 may be received within a first bore of the saddle 120 to position the housing 130 in a first position relative to the housing 130. In like manner, the boss 246 may be received within a second bore of the saddle 120 to position the housing 130 in a second position relative to the housing 130, within a third bore of the saddle 120 to position the housing 130 in a third position relative to the housing 130, and so forth.

The housing 130 may include other features for convenience. For instance, a calendar plate 250 may be attached to or formed integrally with the housing 130. See FIGS. 11-13A. More specifically, the calendar plate 250 may be formed as part of the bottom portion 222 of the housing 130. The calendar plate 250 may be curved. In some examples, the calendar plate 250 may extend in a non-parallel manner with the outer surface 230 of the housing 130. For example, the calendar plate 250 may be defined by an arc length rotating about a point or axis spaced away from the central axis P. See FIG. 11. In this manner, the calendar plate 250 may be "flattened" out relative to the radius of the outer surface 230 of the housing 130.

Figure 12:
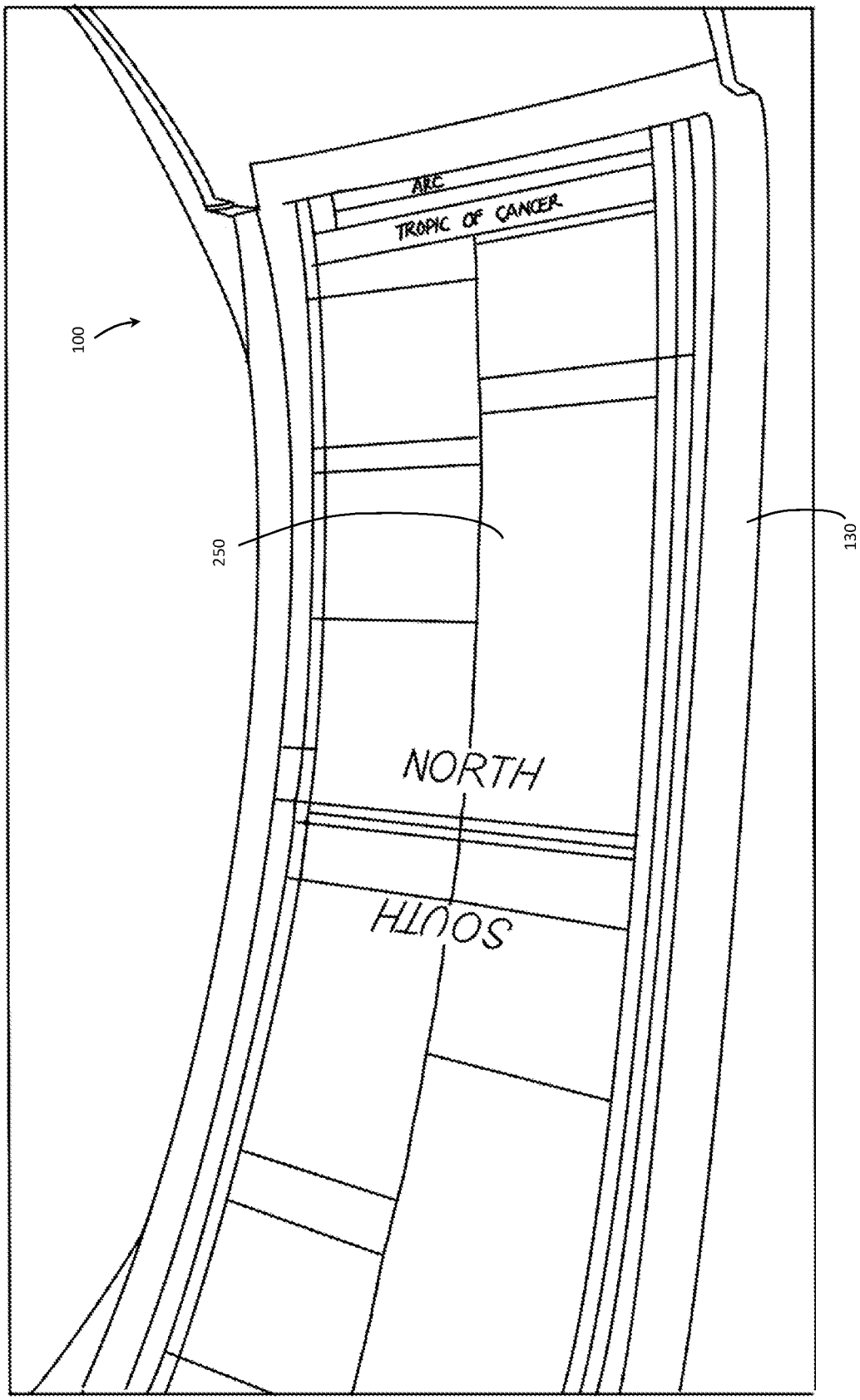
FIG. 12 is an enlarged view of a calendar plate according to some embodiments of the present disclosure.
Figure 13:
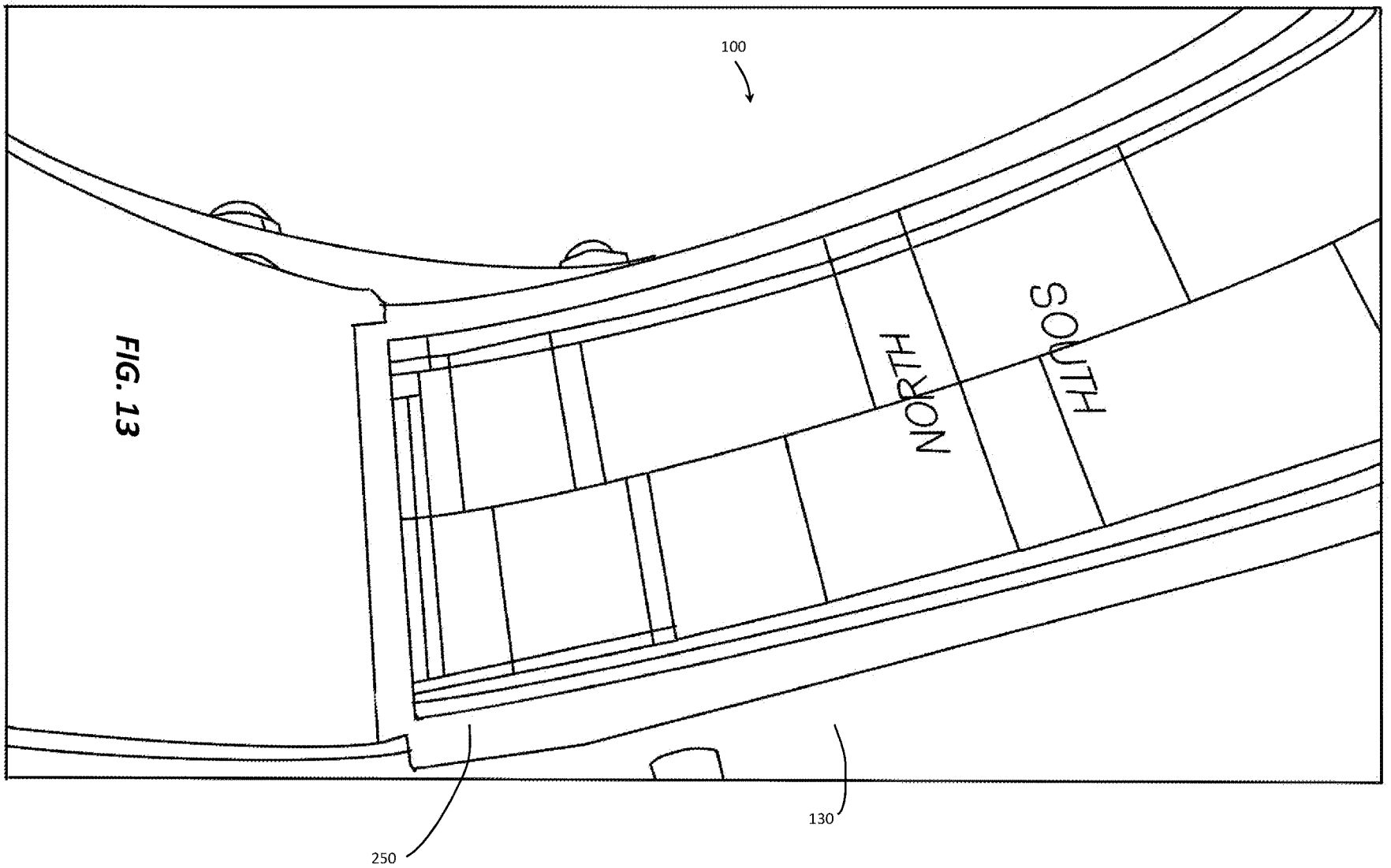
FIG. 13 is another enlarged view of the calendar plate of FIG. 12.
Figure 13A:
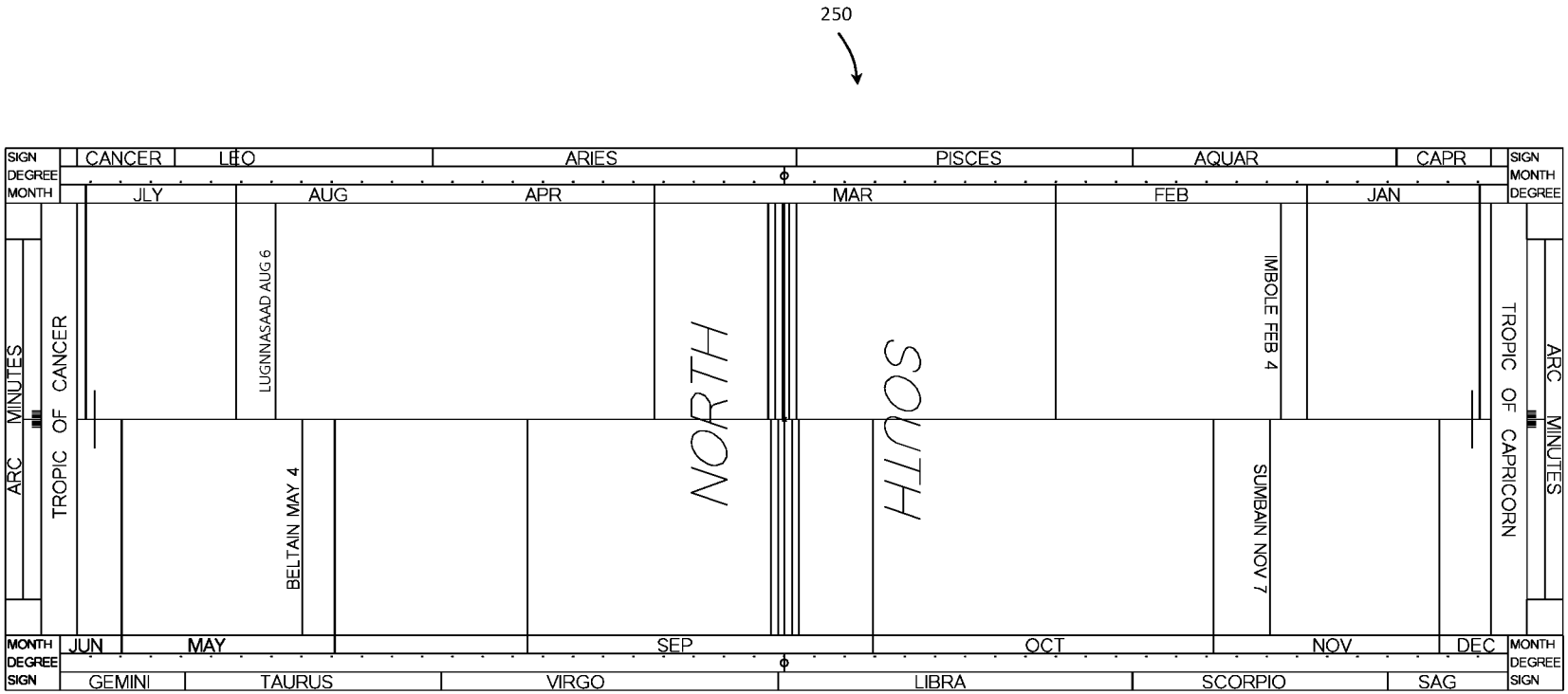
FIG. 13A is a diagram of content in the calendar plate of FIGS. 12-13.
Figure 14:
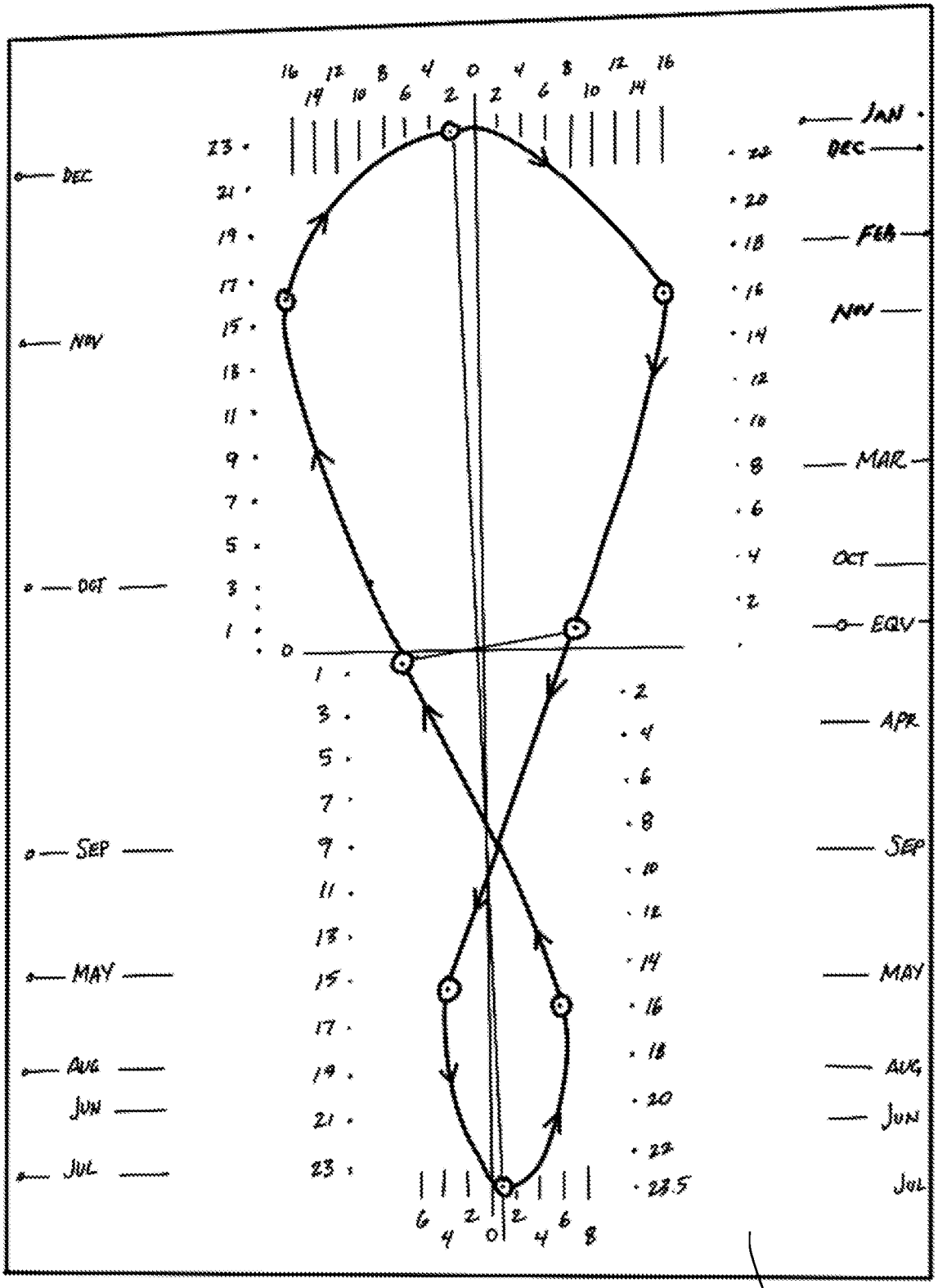
FIG. 14 illustrates an additional calendar plate according to some embodiments of the present disclosure.

The calendar plate 250 may include graduations or other indicia that indicate the time (e.g., month) of year when focused light shines on the calendar plate 250. See FIGS. 12-13A. Thus, as shown in FIG. 13A, which shows a flattened-out version of the information shown on the calendar plate 250 of FIGS. 12-13, areas of the calendar plate 250 can correspond to different months, different zodiac symbols, degrees or arc minutes of the sun relative to the Equator, Tropic of Cancer, or Tropic of Capricorn, the sun's declination or altitude, dates of different astronomical or astrological events, or other periods or markers of time or sun location relative to Earth. See also FIG. 14. Light shining on the calendar plate 250 can be localized in one or more of the blocked-out areas of the calendar plate 250 that correspond to each of these events, dates, or locations, and a viewer can therefore observe the location of the sunlight on the calendar plate 250 at certain times of day in order to determine this information about the relationship between the sun and earth. For example, a reading of the light shining on the calendar plate 250 at noon day may indicate the current calendar month and date or the other information described herein.

In some embodiments, a projected graph of the analema 251 and/or the equation of time may be printed, etched, or otherwise formed on the calendar plate 250. See FIG. 14. Other configurations are also contemplated to indicate the time of year when light shines on the calendar plate 250. Throughout the year, light may shine on the calendar plate 250 to indicate the calendar month or the relationship between sunlight and the seasons (e.g., solstices and equinoxes).

To focus light onto the calendar plate 250, the housing 130 may include an aperture 260 defined through the top portion 220 of the housing 130, such as through the connection portion 240. In such examples, light may pass through the aperture 260 to shine on the calendar plate 250. The aperture 260 may be shaped to account for movement of the sun from season to season, such as to account for longest and shortest days of the year. For instance, the aperture 260 may be cone-shaped in cross-section, with the aperture 260 widening toward the calendar plate 250. See FIG. 10, which shows that the bottom or inner end 261 of the aperture 260 is larger than the opposite end thereof. In one example, the widening angle of the aperture 260 may be equal to or greater than 47 degrees.

Like the base 110 and saddle 120, the housing 130 may be formed in many configurations. For instance, depending on the particular application, the housing 130 may be formed by one or more pieces secured together. For instance, the housing 130 may be formed from a plurality of pieces that are welded, fastened, or otherwise secured together. In some examples, the housing 130 may be milled, cast, forged, molded, or sculpted from a solid piece of material. In some examples, the saddle 120 may be formed by cutting, stamping, rolling, bending, or the like.

Referring to FIGS. 1-5, the equatorial sundial 140 may be attached to the top portion 220 of the housing 130, such as to the connection portion 240 of the housing 130, such as by welding, adhesive, fasteners, or the like. In this manner, the calendar plate 250 may be positioned below the equatorial sundial 140 such that light passing through the aperture 260 shines on the calendar plate 250 to determine the date.

Figure 15:
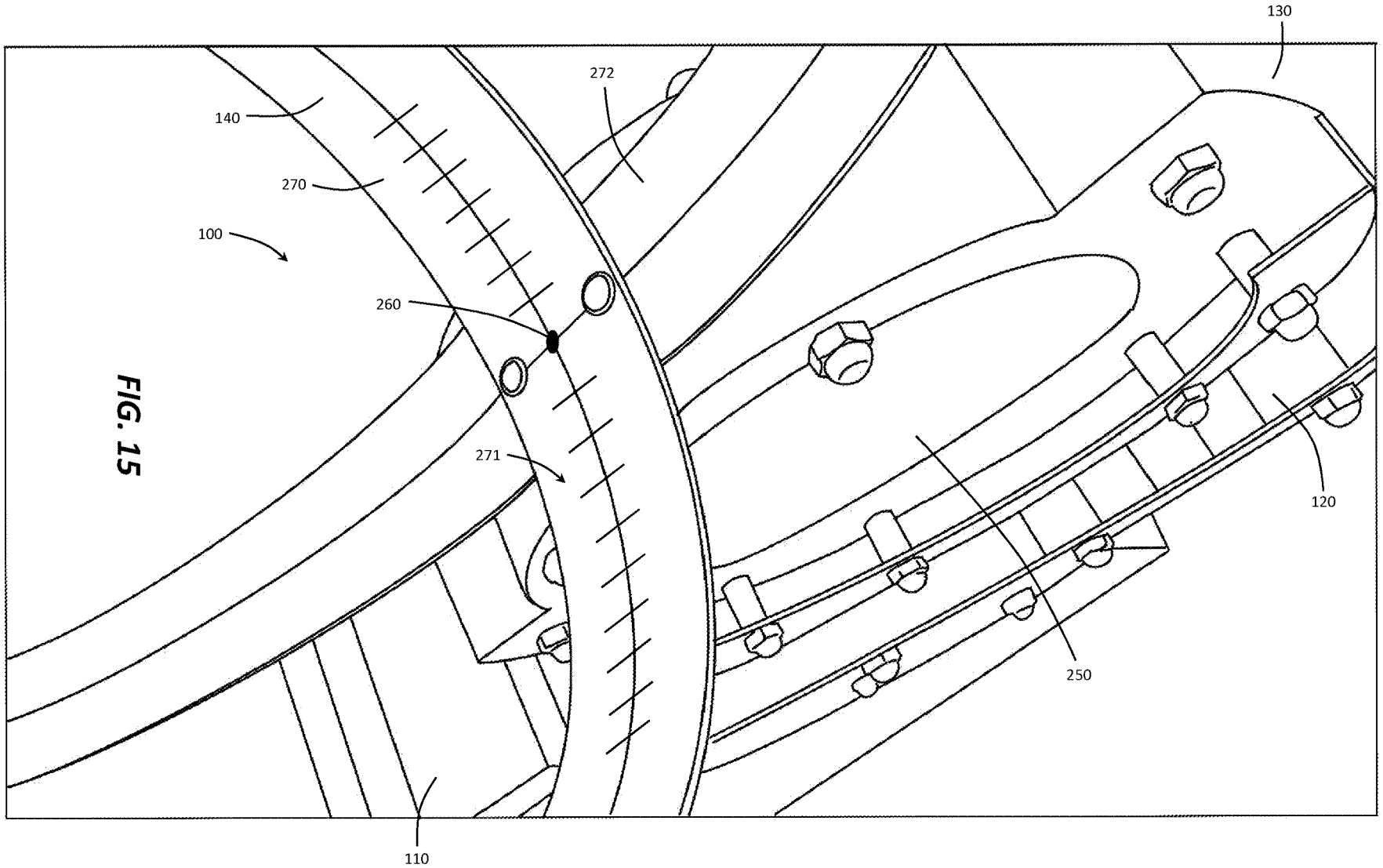
FIG. 15 is a fragmentary view of an equatorial sundial according to some embodiments of the present disclosure.
Figure 17:
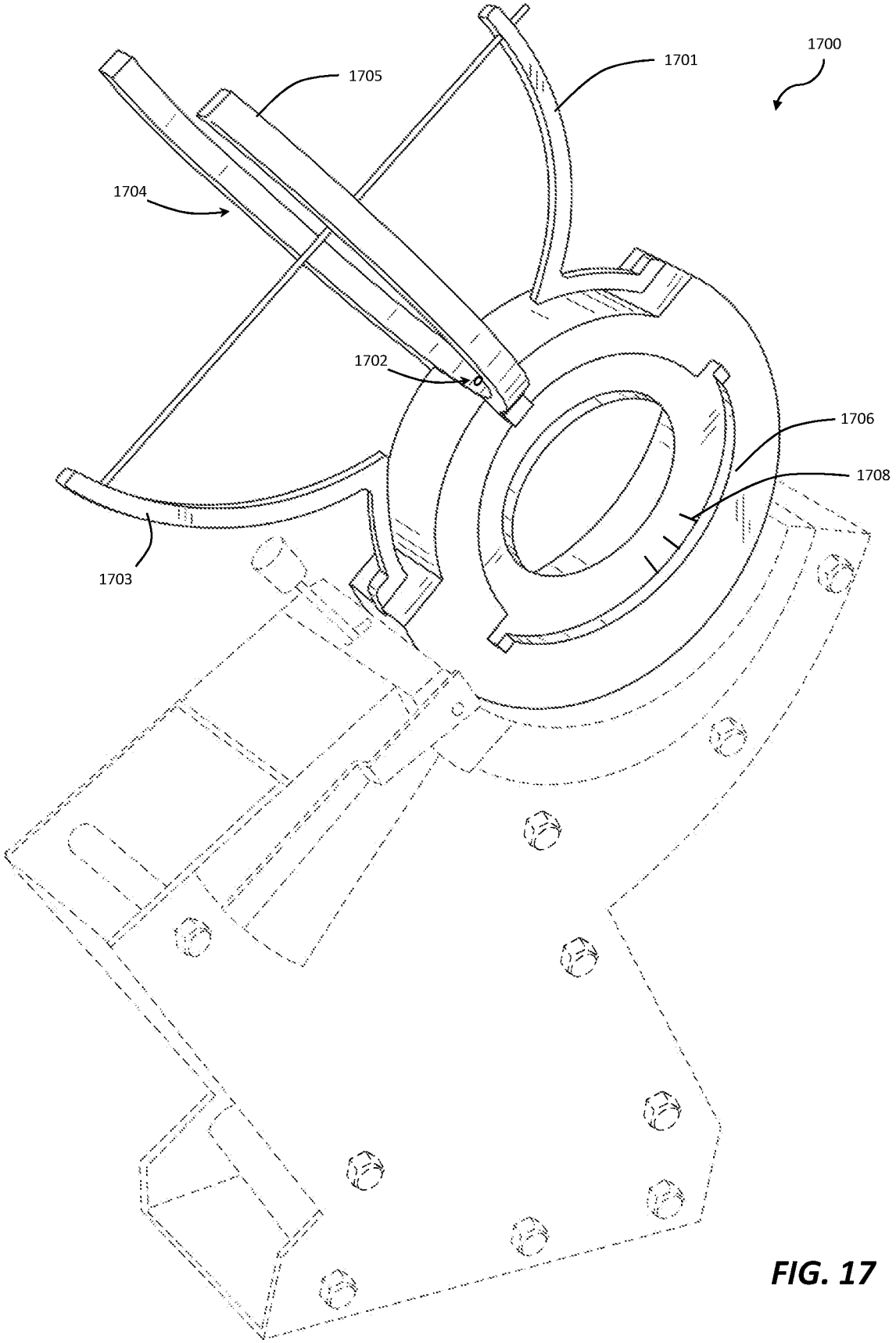
FIG. 17 shows an isometric view of another embodiment of an adjustable sundial assembly.
Figure 18:
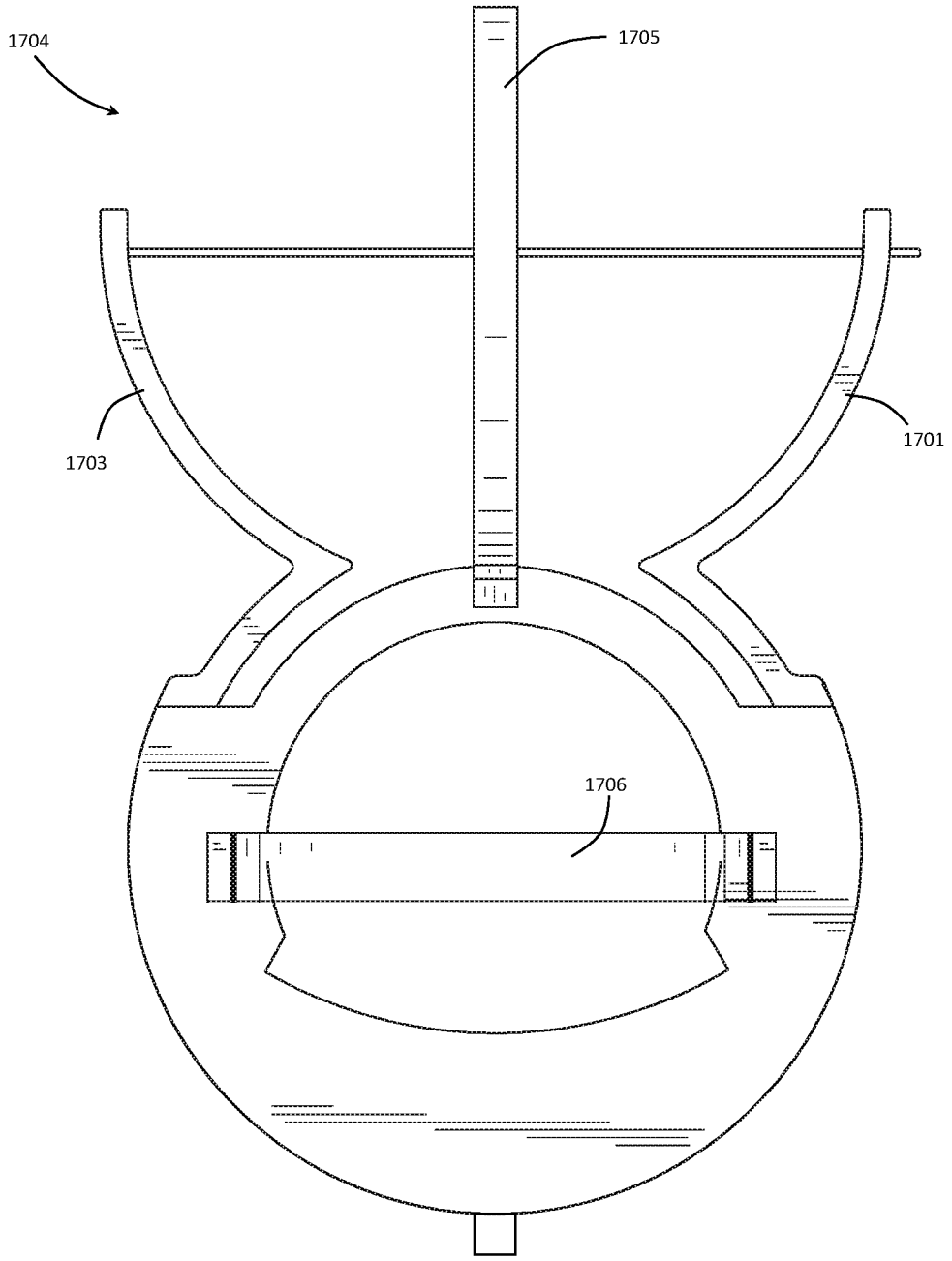
FIG. 18 is a right side view of the sundial assembly of FIG. 17.
Figure 19:
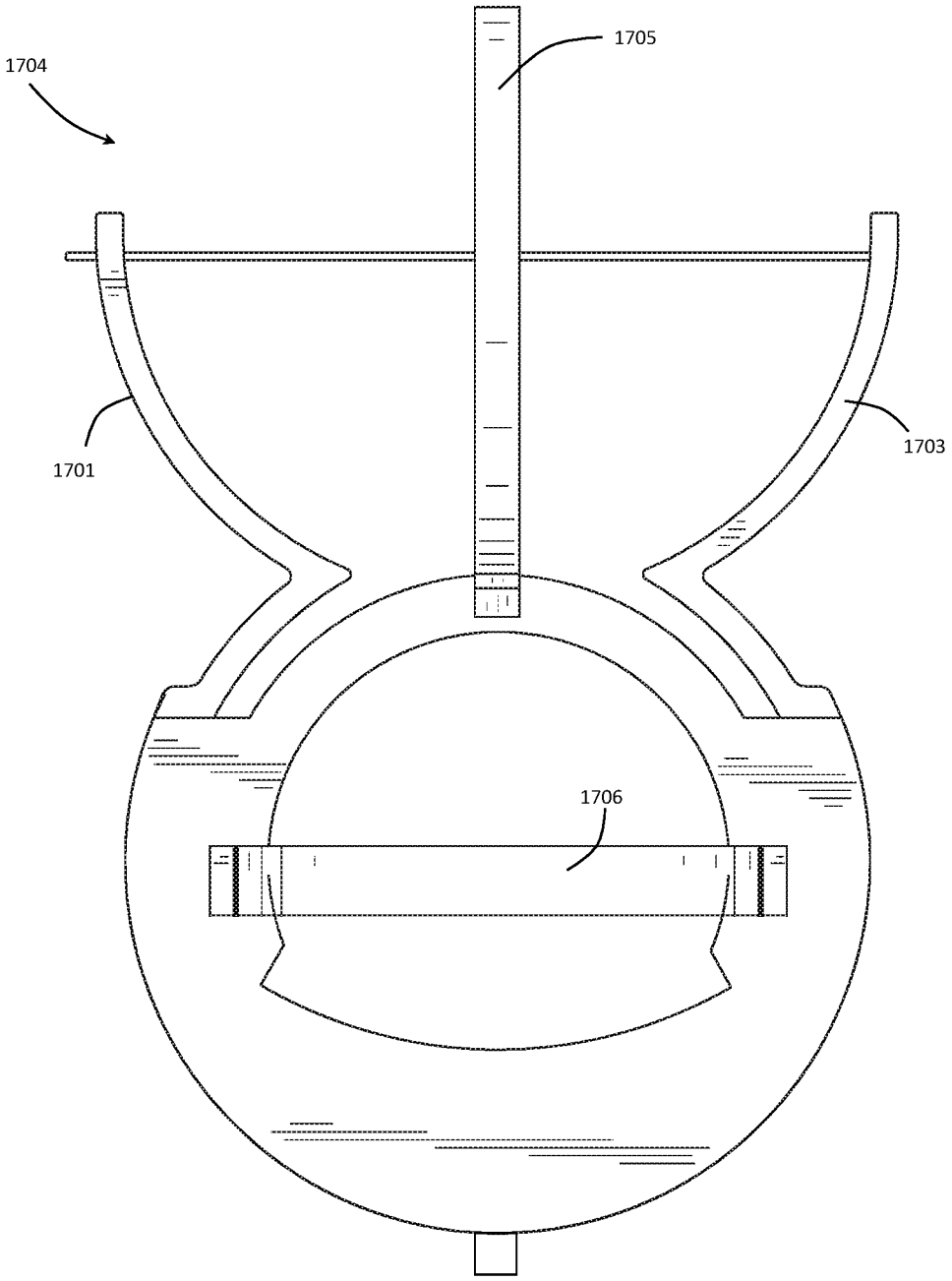
FIG. 19 is a left side view of the upper end of the sundial assembly of FIG. 17.
Figure 20:
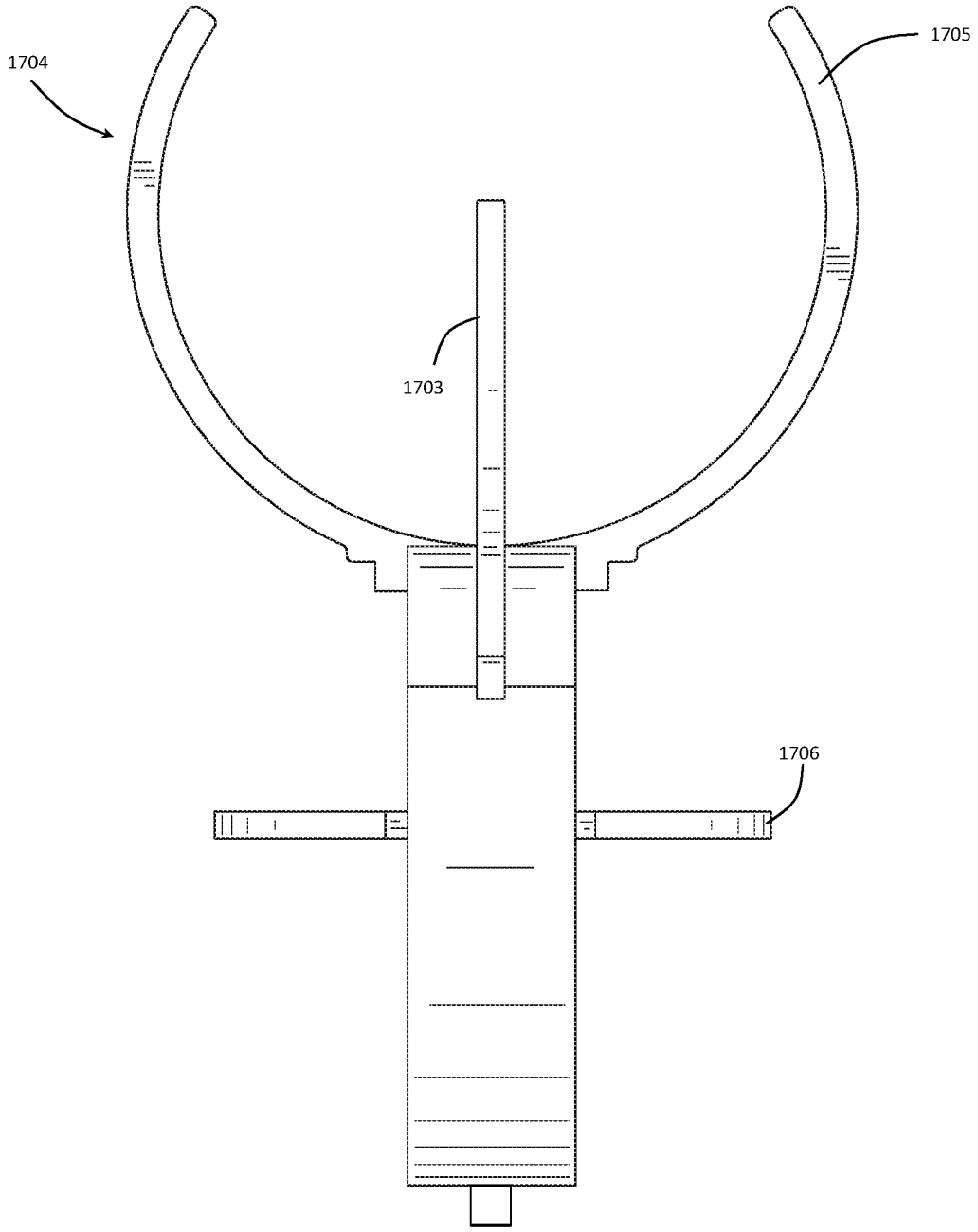
FIG. 20 is a front side view of the upper end of the sundial assembly of FIG. 17.
Figure 21:
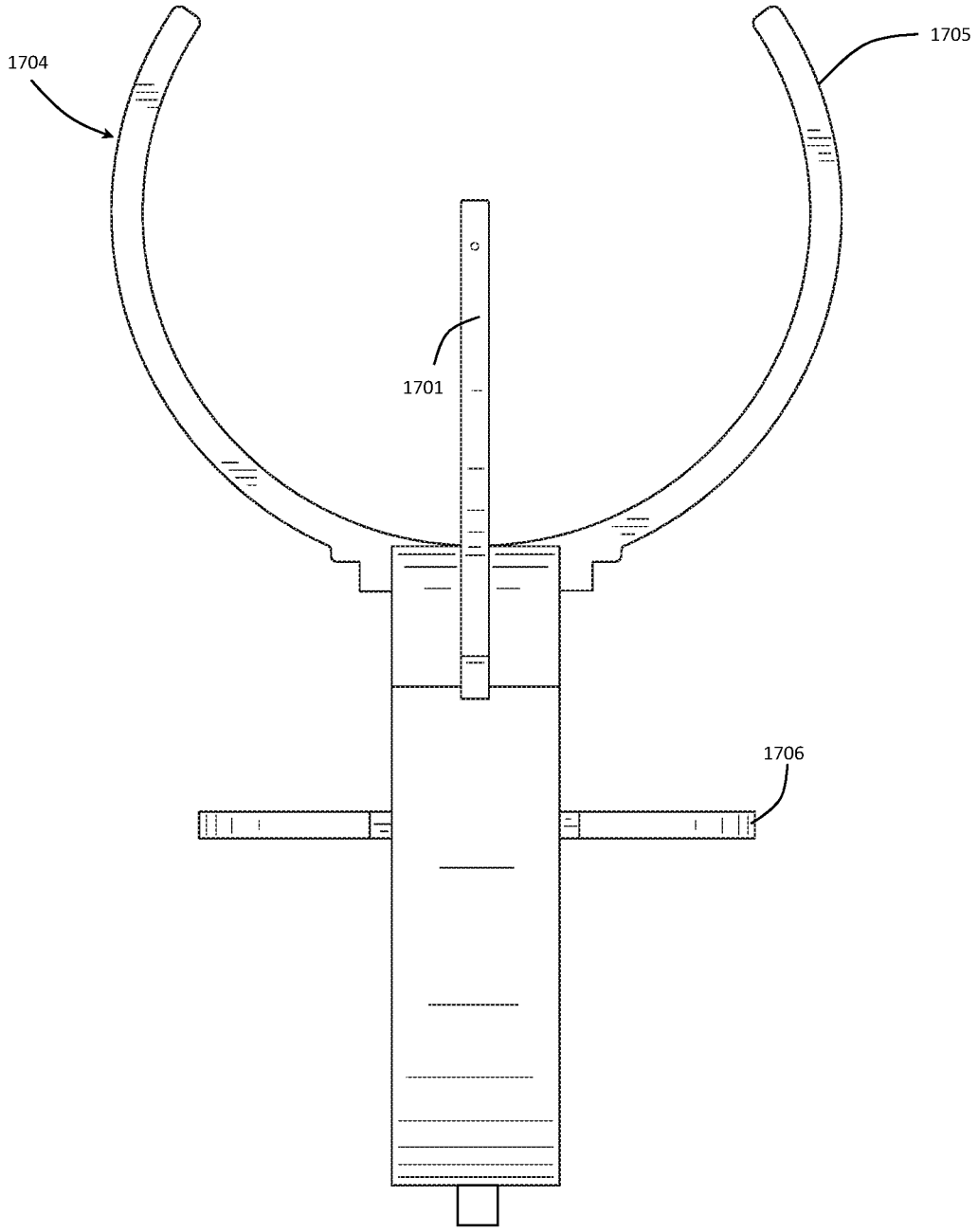
FIG. 21 is a back side view of the upper end of the sundial assembly of FIG. 17.
Figure 22:
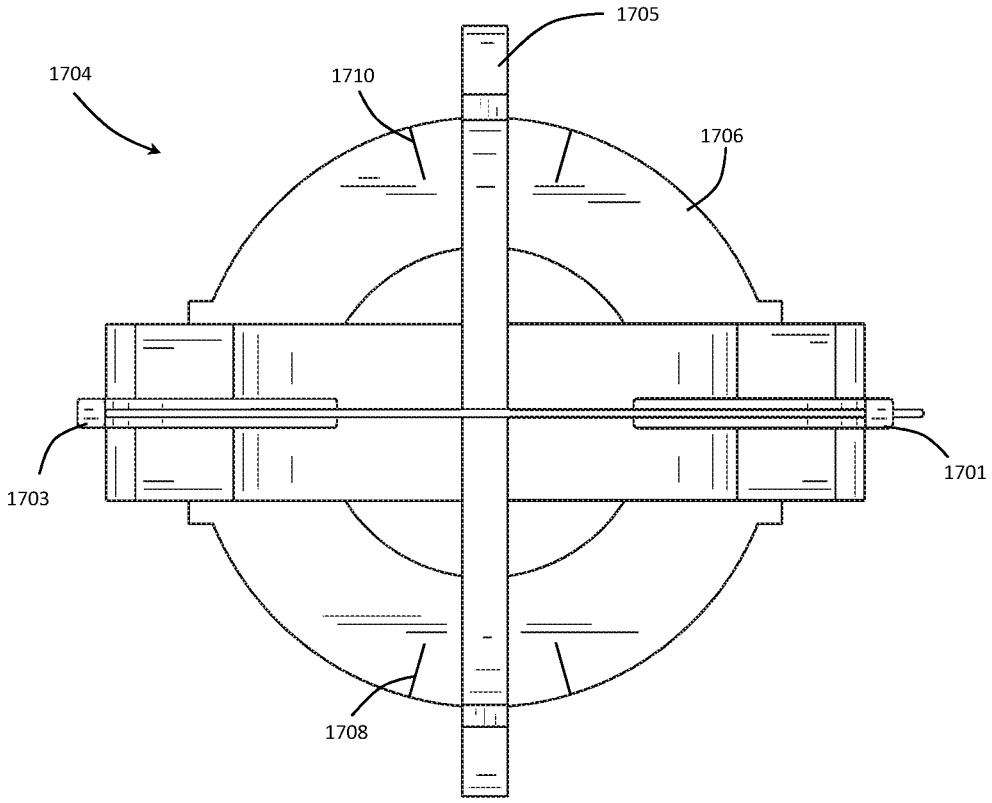
FIG. 22 is a top side view of the upper end of the sundial assembly of FIG. 17.
Figure 23:
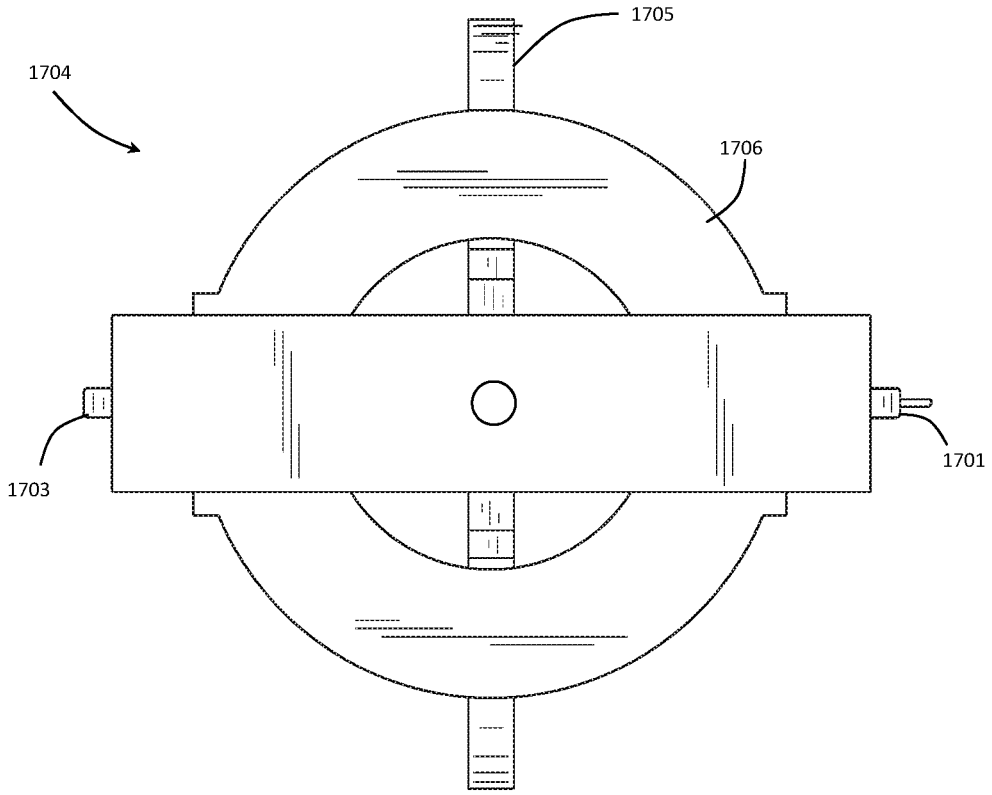
FIG. 23 is a bottom side view of the upper end of the sundial assembly of FIG. 17.

The equatorial sundial 140 may include many configurations operable to display or indicate the correct time of day. As one example, the equatorial sundial 140 may include a plurality of bow elements, such as a first bow element 270 and a second bow element 272. Depending on the particular application, the first and second bow elements 270, 272 may be attached together at the connection portion 240 of the housing 130. In such examples, the aperture 260 may be defined through each of the first and second bow elements 270, 272 at the intersection between the first and second bow elements 270, 272. See FIG. 15. In some embodiments, the aperture 260 may extend through one bow element, as shown by aperture 1702 on the equatorial sundial 1704 of sundial assembly 1700 in FIG. 17.

The equatorial sundial 140 may include a gnomon 280 connected to one of the bow elements to cast a shadow on another bow element. In particular, the gnomon 280 may be connected to the second bow element 272 to cast a shadow on the first bow element 270 to indicate the time of day, as explained in detail below. The gnomon 280 may include many configurations. For instance, the gnomon 280 may be a bow string or bar attached to and extending between terminal ends of the second bow element 272, though other suitable configurations are contemplated. In some examples, the gnomon 280 may be slotted to less occlude the aperture 260 at noon day.

The first bow element 270 may include many configurations. For instance, the first bow element 270 may have a first arc shape defining a first plane. The first bow element 270 may extend generally in an East-West orientation. The first bow element 270 may include a plurality of graduations 271, each graduation corresponding to a time of day. In such examples, the gnomon 280 may cast a shadow on the graduations to indicate the time of day.

The second bow element 272 may include many configurations. For instance, the second bow element 272 may have a second arc shape defining a second plane. In such examples, the first plane defined by the first arc shape of the first bow element 270 may extend perpendicularly to the second plane defined by the second arc shape of the second bow element 272. The second arc shape may be similar to or different than the first arc shape. The second bow element 272 may extend generally in a North-South orientation. For instance, when the base 110 is aligned with either the pole star or the southern cross constellation, the second bow element 272 may also be aligned with the pole star and/or the southern cross constellation.

In some examples, the sundial assembly 100 may include an adjustment assembly 300 adjusting the equatorial sundial 140 relative to the base 110. In particular, the sundial assembly 100 may include one or more adjustment mechanisms operable to adjust an angle between the gnomon 280 and horizontal to account for local latitude. In one example, the sundial assembly 100 includes a first adjustment mechanism 302 (e.g., including boss 246 and bores 210; see FIG. 4) operable to move the housing 130 relative to the saddle 120, and a second adjustment mechanism 304 operable to move the saddle 120 relative to the base 110. In such examples, altering the relative position between the housing 130 and the saddle 120 and/or the relative position between the saddle 120 and the base 110 alters the angle between the gnomon 280 and horizontal to account for local latitude. For example, increasing the angle between the gnomon 280 and horizontal may account for increasing latitudinal positions. Alternatively, decreasing the angle between the gnomon 280 and horizontal may account for decreasing latitudinal positions.

The first adjustment mechanism 302 may alter the angle between the gnomon 280 and horizontal in one or more mass increments or mass angle intervals (i.e., across a set of discrete intervals within a range of a relatively large overall adjustment angle). The first adjustment mechanism 302 can therefore adjust the angle between the gnomon 280 and horizontal across angle intervals having a relatively large minimum size. For instance, each mass increment may be a 10-degree increment or interval between the gnomon 280 and horizontal. In such examples, the first adjustment mechanism 302, which may be referred to as a mass adjustment mechanism, may include adjustment stops at each of a plurality of 10 degree increments. In particular, the first adjustment mechanism 302 may include adjustment stops at each of 0 degrees, 10 degrees, 20 degrees, 30 degrees, 40 degrees, 50 degrees, 60 degrees, 70 degrees, and 80 degrees relative to horizontal. Depending on the particular application, the first adjustment mechanism 302 may be defined by the adjustable coupling of the housing 130 to the saddle 120. For instance, the adjustment stops of the first adjustment mechanism 302 may be defined by the boss 246 of the housing 130 received, at least partially, within one of the bores 210 of the saddle 120. In such examples, the mass increments may be defined by the position of the bores 210 within the saddle 120.

The second adjustment mechanism 304 may alter the angle between the gnomon 280 and horizontal from zero up to a single mass increment of the first adjustment mechanism 302. In other words, the second adjustment mechanism 304 may adjust the angle between angles that are less than the mass increments of the first adjustment mechanism 302 (i.e., fine angle intervals). The second adjustment mechanism 304 can therefore adjust the angle between the gnomon 280 and horizontal across angle intervals that up to, but less than, the relatively large minimum size of the angle intervals of the first adjustment mechanism 302. For instance, the second adjustment mechanism 304, which may be referred to as a minor or fine tuning adjustment mechanism, may alter the angle between each 10-degree increment. Depending on the particular application, the second adjustment mechanism 304 may selectively slide the saddle 120 relative to the base 110. For instance, the second adjustment mechanism 304 may be a leadscrew connected to the base 110. In such examples, the leadscrew may contact the first end panel 194 of the saddle 120 to move the first end panel 194 toward or away from the leading end portion 150 of the base 110 upon selective rotation of the leadscrew within an opening 305 (e.g., a threaded opening) in the base 110. Due to the trailing end portion 152 of the base 110 being higher than the leading end portion 150, the saddle 120 may be biased toward the second adjustment mechanism 304 to prevent undesired movement of the saddle 120 relative to the base 110.

Calibrating the sundial assembly 100 for local latitude may utilize both the first and second adjustment mechanisms 302, 304. In some examples, the first and second adjustment mechanisms 302, 304 may be utilized in sequence to calibrate the sundial assembly 100 for local latitude. For example, to set the angle between the gnomon 280 and horizontal at 45.7 degrees (to account for local latitude in Bozeman, Mont., for instance), the first adjustment mechanism 302 may be first utilized to alter the angle up to a mass increment of 40 degrees. In particular, the housing 130 may be adjustably coupled to the saddle 120 such that the boss 246 of the housing 130 is received within the bore 210 of the saddle 120 corresponding to a 40 degree mass increment. Once the first adjustment mechanism 302 is set at 40 degrees, the second adjustment mechanism 304 may then be utilized to dial the angle an additional 5.7 degrees to reach a total angle adjustment of 45.7 degrees. For instance, the second adjustment mechanism 304 may be actuated to slide the saddle 120 along the bearing surface 170 and away from the leading end portion 150 of the base 110 an amount equating to 5.7 degrees of angle adjustment, as determined by the pointer 214 of the saddle 120 moving along the scale 180 of the base 110.

Figure 16:
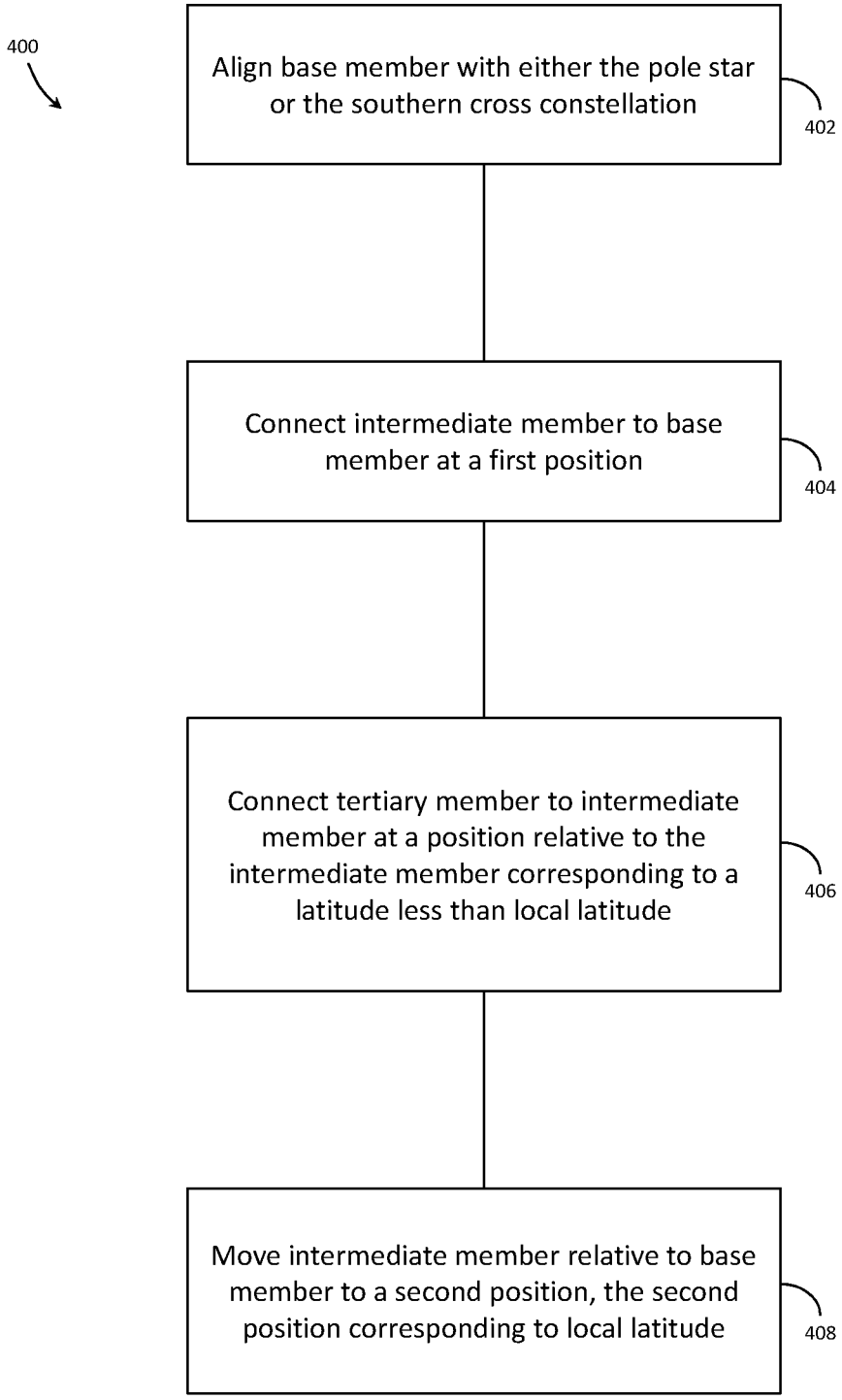
FIG. 16 is a chart illustrating a method of adjusting a sundial according to some embodiments of the present disclosure.

FIG. 16 is a chart illustrating a method 400 of adjusting a sundial, such as sundial assembly 100, to account for local latitude. Referring to FIG. 16, the method 400 may begin with aligning a base member, such as base 110, with either the pole star or the southern cross constellation (as shown in block 402). For instance, as explained above, the base 110 may be positioned such that either the pole star or the southern cross constellation is aligned with the alignment plane defined by the leading and trailing end portions 150, 152 of the base 110. As noted above, alignment of the base 110 with either the pole star or the southern cross constellation depends on whether the sundial assembly 100 is to be positioned within the northern hemisphere or the southern hemisphere. For instance, when positioning the sundial assembly 100 in the northern hemisphere, the base 110 is to be aligned toward the pole star. When positioning the sundial assembly 100 in the southern hemisphere, the base 110 is to be aligned toward the southern cross constellation.

With continued reference to FIG. 16, the method 400 may include connecting an intermediate member, such as saddle 120, to the base member at a first position (as shown in block 404). For example, the saddle 120 may be slidably connected to the base 110 at a relative position indicated as 0 degrees on the scale 180 attached to the base 110.

The method 400 may include connecting a tertiary member, such as housing 130, to the intermediate member at a position relative to the intermediate member corresponding to a latitude less than the local latitude (as shown in block 406). For instance, as explained above, the housing 130 may be connected to the saddle 120 at one of a plurality of mass increments each corresponding to a 10 degree increment relative to each other. In such examples, the housing 130 may be connected to the saddle 120 at a 10 degree increment just short of the local latitude (e.g., at a mass increment that is less than 10 degrees away from local latitude). Connecting the tertiary member to the intermediate member may include positioning one or more bosses 246 of the tertiary member within one or more bores 210 defined in the intermediate member.

Continuing to refer to FIG. 16, the method 400 may include moving the intermediate member relative to the base member to a second position, the second position corresponding to the local latitude (as shown in block 408). For instance, the saddle 120 may be slid relative to the base 110, such as via the second adjustment mechanism 304, until the scale 180 on the base 110 indicates the local latitude in combination with the mass increment of the housing 130 relative to the saddle 120. Moving the intermediate member relative to the base member may include sliding the intermediate member along a portion of the base member in an arc.

FIGS. 17-23 show various views of an upper end of an equatorial sundial 1704 of an adjustable sundial assembly 1700. The base and saddle portions are shown in broken lines. As shown in these figures, the adjustable sundial assembly 1700 can have an equatorial sundial with arc- or bow-shaped elements that are spaced apart from each other. In some embodiments, at least one of the bow elements comprises two arc-shaped portions 1701, 1703 that are spaced apart from each other and that have another bow element 1705 positioned extending across the sundial assembly 1700 in the space between the portions. The middle bow element may comprise an aperture 1702 to allow light to pass into the equatorial sundial 1704. In some embodiments, a gnomon can be suspended across a perpendicular arc element without having both of its ends attached to another arc element.

FIGS. 17-23 also show a sunrise/sunset indicator 1706 (i.e., compass ring) attached to the housing of the sundial assembly 1700. The sunrise/sunset indicator 1706 may be oriented perpendicular to the alignment plane of the assembly 1700 and parallel to the gnomon. The sunrise/sunset indicator 1706 may have a central gap or opening through which light can shine from the aperture 1702 to the calendar plate. Thus, in some cases the sunrise/sunset indicator 1706 can comprise a ring or annular shape.

The outer perimeter of the sunrise/sunset indicator 1706 can extend in eastern and western directions from the alignment plane and can comprise a set of directional indicators (e.g., indicators 1708, 1710). See FIG. 22. The set of directional indicators 1708, 1710 can comprise a set of markings, arrows, protrusions, engravings, words, or other indicators that correspond to directions from which the sun rises (on the eastern side of the sundial assembly 1700) or toward which the sun sets (on the western side thereof). A plurality of sunrise indicators 1708 can be located on the sunrise/sunset indicator 1706 that each correlate to the location of the sunrise at different times of the year, and a similar plurality of sunset indicators 1710 can be provided to indicate the location of the sunset throughout the year. Thus, in some embodiments, the indicators 1708, 1710 can comprise calendar information to assist the user in identifying the direction of the sunrise or sunset based on the calendar date. Additionally, in some embodiments, the sunrise/sunset indicator 1706 can provide indication of compass directions (e.g., East, West, Southeast, Northwest, etc.) to provide additional utility to a viewer.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the structures disclosed herein, and do not create limitations, particularly as to the position, orientation, or use of such structures. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification and examples provide a complete description of the structure and use of exemplary examples of the invention as defined in the claims. Although various examples of the claimed invention have been described above with a certain degree of particularity, or with reference to one or more individual examples, those skilled in the art could make numerous alterations to the disclosed examples without departing from the spirit or scope of the claimed invention. Other examples are therefore contemplated. It is intended that all matter contained in the above description and shown in the accompanying drawings shall be interpreted as illustrative only of particular examples and not limiting. Changes in detail or structure may be made without departing from the basic elements of the invention as defined in the following claims.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An adjustable sundial assembly comprising:
- a base;
- a saddle slidably connected to the base and configured to move in an arc relative to the base;
- a housing adjustably coupled to the saddle; and
- an equatorial sundial attached to the housing, the equatorial sundial comprising:
  - a first bow element having a first arc shape;
  - a second bow element having a second arc shape, wherein the first and second bow elements are attached together at a connection portion of the housing;
  - a calendar plate attached to or formed integrally with the housing; and
  - an aperture defined through the connection portion of the housing such that light passing through the aperture is focused onto the calendar plate.

2. The adjustable sundial assembly of claim 1, wherein a plane defined by the first bow element extends perpendicularly to a plane defined by the second bow element.

3. The adjustable sundial assembly of claim 1, further comprising:
- a plurality of graduations defined on the first bow element, each graduation corresponding to a time of day;
- a gnomon connected to the second bow element to cast a shadow on the graduations of the first bow element to indicate the time of day.

4. The adjustable sundial assembly of claim 3, wherein the gnomon is a bow string attached to terminal ends of the second bow element.

5. The adjustable sundial assembly of claim 1, wherein the first arc shape is different than the second arc shape.

6. The adjustable sundial assembly of claim 1, further comprising an adjustment assembly to adjust the equatorial sundial relative to the base.

7. The adjustable sundial assembly of claim 6, wherein the adjustment assembly comprises:
- an adjustment mechanism operable to move the saddle relative to the base;
- a scale associated with the base; and
- a pointer connected to the saddle and positioned to move along the scale to indicate the position of the saddle relative to the base.

8. The adjustable sundial assembly of claim 1, wherein:
- the saddle includes a plurality of bores;
- the housing includes at least one boss received within a selected one or more bores of the plurality of bores to adjustably couple the housing to the saddle.

9. The adjustable sundial assembly of claim 1, wherein:
- the saddle sits atop the base;
- the housing sits atop the saddle; and
- the equatorial sundial sits atop the housing.

10. The adjustable sundial assembly of claim 1, wherein moving the saddle relative to the base and moving the housing relative to the saddle tilts the equatorial sundial toward the base.

11. An adjustable sundial assembly comprising:
- a base;
- a saddle slidably connected to the base and configured to move in an arc relative to the base;
- a housing adjustably coupled to the saddle; and
- an equatorial sundial attached to the housing, the equatorial sundial comprising:
  - a first bow element having a first arc shape; and
  - a second bow element having a second arc shape, wherein the first and second bow elements are attached together at a connection portion of the housing, and wherein the first arc shape is different than the second arc shape.

12. The adjustable sundial assembly of claim 11, further comprising:
- a plurality of graduations defined on the first bow element, each graduation corresponding to a time of day;
- a gnomon connected to the second bow element to cast a shadow on the graduations of the first bow element to indicate the time of day.

13. The adjustable sundial assembly of claim 12, wherein the gnomon is a bow string attached to terminal ends of the second bow element.

14. The adjustable sundial assembly of claim 11, further comprising an adjustment assembly to adjust the equatorial sundial relative to the base.

15. The adjustable sundial assembly of claim 14, wherein the adjustment assembly comprises:
- an adjustment mechanism operable to move the saddle relative to the base;
- a scale associated with the base; and
- a pointer connected to the saddle and positioned to move along the scale to indicate the position of the saddle relative to the base.

16. An adjustable sundial assembly comprising:
- a base;
- a saddle slidably connected to the base and configured to move in an arc relative to the base, wherein the saddle includes a plurality of bores;
- a housing adjustably coupled to the saddle, wherein the housing includes at least one boss received within a selected one or more bores of the plurality of bores to adjustably couple the housing to the saddle; and
- an equatorial sundial attached to the housing.

17. The adjustable sundial assembly of claim 16, wherein:
- the saddle sits atop the base;
- the housing sits atop the saddle; and
- the equatorial sundial sits atop the housing.

18. The adjustable sundial assembly of claim 16, further comprising an adjustment assembly to adjust the equatorial sundial relative to the base.

19. The adjustable sundial assembly of claim 18, wherein the adjustment assembly comprises:

an adjustment mechanism operable to move the saddle relative to the base;

a scale associated with the base; and a pointer connected to the saddle and positioned to move along the scale to indicate the position of the saddle relative to the base.

20. The adjustable sundial assembly of claim 16, wherein moving the saddle relative to the base and moving the housing relative to the saddle tilts the equatorial sundial toward the base.

* * * * *